US007240522B2

(12) United States Patent
Kondou et al.

(10) Patent No.: US 7,240,522 B2
(45) **Date of Patent: *Jul. 10, 2007**

(54) ELASTIC KNITTING FABRIC HAVING MULTILAYER STRUCTURE

(75) Inventors: Toshiyuki Kondou, Ibaraki (JP); Tomoaki Yoshida, Hirakata (JP); Kazuo Furuya, Tokyo (JP)

(73) Assignee: Asahi Kasei Fibers Corporation, Osaka (JP)

( * ) Notice: Subject to any disclaimer, the term of this patent is extended or adjusted under 35 U.S.C. 154(b) by 0 days.

This patent is subject to a terminal disclaimer.

(21) Appl. No.: 10/492,358

(22) PCT Filed: Oct. 15, 2002

(86) PCT No.: PCT/JP02/10675

§ 371 (c)(1),
(2), (4) Date: Apr. 13, 2004

(87) PCT Pub. No.: WO03/038173

PCT Pub. Date: May 8, 2003

(65) Prior Publication Data

US 2004/0237599 A1 Dec. 2, 2004

(30) Foreign Application Priority Data

| | | |
|---|---|---|
| Oct. 31, 2001 | (JP) | 2001-335172 |
| Jan. 11, 2002 | (JP) | 2002-004973 |
| Apr. 5, 2002 | (JP) | 2002-103403 |
| Jun. 19, 2002 | (JP) | 2002-178782 |

(51) Int. Cl.
*D04B 21/08* (2006.01)

(52) U.S. Cl. ..... 66/195

(58) Field of Classification Search ..... 66/195, 66/193, 196, 192

See application file for complete search history.

(56) References Cited

U.S. PATENT DOCUMENTS

| | | | | |
|---|---|---|---|---|
| 3,971,234 | A | 7/1976 | Taylor | |
| 4,651,938 | A | 3/1987 | Memminger et al. | 242/64 R |
| 4,785,558 | A * | 11/1988 | Shiomura | 66/196 |
| 4,787,219 | A * | 11/1988 | Sato et al. | 66/190 |
| 5,385,036 | A * | 1/1995 | Spillane et al. | 66/87 |
| 5,651,847 | A * | 7/1997 | Loeffler | 66/19 |
| 5,896,758 | A * | 4/1999 | Rock et al. | 66/191 |
| 6,105,401 | A * | 8/2000 | Chadeyron et al. | 66/195 |
| 6,116,059 | A * | 9/2000 | Rock et al. | 66/191 |
| 6,196,032 | B1 * | 3/2001 | Rock et al. | 66/195 |
| 6,199,410 | B1 * | 3/2001 | Rock et al. | 66/195 |
| 6,644,070 | B2 * | 11/2003 | Ikenaga et al. | 66/196 |

FOREIGN PATENT DOCUMENTS

| | | |
|---|---|---|
| EP | 0 431 984 B1 | 6/1991 |
| EP | 1 052 319 A1 | 11/2000 |
| JP | 51-17373 | 2/1979 |

(Continued)

*Primary Examiner*—Danny Worrell
(74) *Attorney, Agent, or Firm*—Finnegan, Henderson, Farabow, Garrett & Dunner, L.L.P.

(57) ABSTRACT

An elastic knitted fabric having a multilayer structure, made by binding separate front and back two-layer ground knitted fabrics together, wherein the above described two-layer ground knitted fabrics are bound together with only a bare string(s) of polyurethane based elastic fibers of 17 to 3000 decitexes.

16 Claims, 5 Drawing Sheets

FOREIGN PATENT DOCUMENTS

| | | |
|---|---|---|
| JP | 60-9914 | 1/1985 |
| JP | 4-240252 | 8/1992 |
| JP | 5-106146 | 4/1993 |
| JP | 7-316959 | 12/1995 |
| JP | 2001-16444 | 6/2001 |
| JP | 2001-214349 | 8/2001 |

* cited by examiner

ELASTIC KNITTING FABRIC HAVING MULTILAYER STRUCTURE

TECHNICAL FIELD

The present invention relates to a circular elastic knitted fabric having a multilayer structure, made by binding front and back two ground knitted fabrics together with a binding yarn, a warp elastic knitted fabric, a process for manufacturing the same, and an apparatus for manufacturing the circular elastic knitted fabric of the present invention. More particularly, the present invention relates to an elastic knitted fabric having a three-layer structure with front and back two ground knitted fabrics bound together, or a three-dimensional structure having an air gap between front and back two ground knitted fabrics. That is, the present invention relates to an elastic knitted fabric having excellent stretchability, being dense, light and excellent in shape stability, being hard to be flattened even under repeated loads in the case of the three-dimensional elastic knitted fabric, having excellent compressibility and compression recoverability, and being excellent in air permeability and heat retaining property, a process for manufacturing the same, and a knitting apparatus.

BACKGROUND ART

Traditionally, usual yarns (yarns commonly used, such as a filament, false twist yarn or spun yarn) are often used as jointing yarns (binding yarns) for binding front and back faces together for three-dimensional structure knitted fabrics made using many types of weft knitting machines and warp knitting machines that have been proposed. These are mainly used for linings and the like of general materials and cloths, and have an effect of adding appropriate thermal insulation characteristics, but are poor in compressibility and compression recoverability.

Furthermore, a three-dimensional structure knitted fabric using a heat seal yarn as a binding yarn is known in the art, and examples of the three-dimensional structure knitted fabrics include a knitted fabric described in JP-A-4-240252. This knitted fabric is a mold product utilizing formability of the heat seal yarn, and is suitable for pressure forming such as heat press adequate for the formability, but has almost no compressibility and compression recoverability, and flattening resistance or the like under repeated loads is not considered.

Furthermore, for the example of a knitted fabric described in JP-A-7-316959, a circular corrugated knit using a connecting yarn in combination with a heat seal yarn and a highly crimped yarn is proposed. Use of polyurethane and the like in the connecting yarn is described in this publication. Furthermore, a three-dimensional knitted fabric using a binding yarn in combination with a heat seal yarn and a stretchable yarn (polyurethane based elastic fibers, etc.) is described in JP-A-2001-164444. They are to provide a cushioning property with the highly crimped yarn and the stretchable yarn and reduce flattening under repeated loads, but has a problem such that when the heat seal yarn is used in the connecting yarn, the low softening point of the heat seal yarn causes creases to occur in a substrate during dyeing processing and the like, the creases are not eliminated after finishing, and the heat seal yarn as a connecting yarn is heat-sealed to fix the front and back knitted fabrics, so that the knitted fabric as a whole has almost no stretchability, exhibits neither cushioning property nor flattening resistance by the effects of the highly crimped yarn and the stretchable yarn, is poor in compressibility and compression recoverability, and is flattened under repeated loads. Further, non-elastic fibers used in the connecting yarn and the ground knitted fabric are heat-sealed, so that the knitted fabric as a whole becomes rigid, and although finding some application for industrial materials, it is not suitable at all as a general material or sub-material worn by a person or used at a location close to a skin, and cannot be practically used in this field.

On the other hand, as a similar product, a three-layer structure knitted fabric manufactured by a double raschel machine, which is one type of warp knitted fabric, is commercially available. This knitted fabric uses a monofilament as a binding yarn. Use of the monofilament is intended for improving the cushioning property by means of its high degree of elasticity. However, this three-dimensional structure knitted fabric is rigid as a whole due to stiffness of the monofilament, and is therefore unsuitable as a fabric worn by a person as in the case described above.

JP-A-5-106146 describes a process of connecting one knitted fabric and the other knitted fabric with an elastic yarn, and using methods such as the increasing/decreasing of knitting courses achievable only by a flatbed knitting machine and partial knitting to knit a highly rugged and firm knitted fabric. However, the flatbed knitting machine has a rough gage, and therefore requires that several strings of yarn having a large size, for example bulky wool yarn or highly crimped thick synthetic fiber long finished yarn should be arranged for knitting, and the knitted fabric thus formed is a sweater or the like having rough stitches, and a dense and light knitted fabric desired in the present invention cannot be obtained. Furthermore, a stable shape cannot be retained even when the thickness of the binding yarn is increased because of the rough gage, and the warp and weft elongation balance of the knitted fabric is not satisfactory. Furthermore, the prior art has technological ideology of a method of three-dimensionally knitting a fabric along a silhouette of a human body, but has no concept of providing the knitted fabric itself with a three-dimensional structure having an air gap. Further, the flatbed knitting machine has a fatal problem such that a yarn feeding port travels to and fro along with a carriage, and a yarn is fed from the yarn feeding port and a knitting motion is repeated, but when an elastic yarn is knitted, the draw ratio varies along the width direction if using a bare string, thus making it impossible to obtain uniform stitches. Thus, it is common sense among those skilled in the art that no bare string is used, but so called a covering finished yarn with non-elastic fibers previously wound around a bare string of elastic yarn is used.

Furthermore, EP Patent Publication No. 431984 describes a knitted fabric for cloths allowing water in the body to be easily transpired to outside, having two knitted fabrics connected together with an elastic yarn, with the back face constituted by water repellent fibers alone and the front face constituted by water absorptive fibers and a platting-knitted elastic yarn. The purpose of using an elastic yarn for the front knitted fabric is to make stitches of the front knitted fabric denser to prevent the entrance of the outside air into the knitted fabric, and the technique is different from the present invention in both technological challenge and purpose. In the knitted fabric having this configuration, curling tends to occur because the front face and the back face have different degrees of stretchability, but use of an elastic yarn for the back face to add stretchability is not acceptable in view of its purpose. Specifically, if the elastic yarn is used for the back face to make the stitches denser in this knitted fabric, water in the body cannot be transferred through the knitted fabric, thus making it impossible to transpire water to the outside. Therefore, in the knitted fabric having this configuration, occurrence of curling cannot be inhibited, and a trouble arises in forming the knitted fabric into a cloth.

Furthermore, traditionally, when a bare string of polyurethane based elastic fibers is knitted by a circular knitting machine, all spandex based elastic fibers on the knitting machine can be fed to the knitting machine only at a same rate due to machine-related restriction, and if different weaves are to be knitted with polyurethane based elastic fibers, they can be knitted only at the, feed speeds relatively close to each other. As a result, polyurethane based elastic fibers suffer yarn breakage due to excessive drawing and fault drawing from a package of fibers due to insufficient drawing when the fibers are knitted. Consequently, weave-related restriction is significant, and knitting conditions are limited, so that the knitted fabric becomes too dense, and adequate stretchability cannot be obtained.

DISCLOSURE OF THE INVENTION

An object of the present invention relates to an elastic knitted fabric having a three-layer structure with front and back two ground knitted fabrics bound together, or a three-dimensional structure having an air gap between front and back two ground knitted fabrics, and is to provide an elastic knitted fabric having excellent stretchability, being dense, light and excellent in shape stability, having a soft feel, and being most suitable for cloths worn by a person or used at a location close to the skin, general materials and sub-materials.

Another object of the present invention is to provide an elastic knitted fabric being hard to be flattened under repeated loads in the case of a three-dimensional structure knitted fabric, having excellent compressibility and compression recoverability, and being excellent in air permeability and heat retaining property, a process for manufacturing the same, and a knitting apparatus for realizing the same.

That is, the present invention is as follows:

(a) an elastic knitted fabric having a multilayer structure, made by binding together separate front and back ground knitted fabrics, wherein the above described two ground knitted fabrics are bound with only a polyurethane based elastic fiber bare string(s) of 17 to 3000 decitexes;

2) the elastic knitted fabric of (1), wherein the above described elastic knitted fabric is a circular knitted fabric with the separate front and back ground knitted fabrics each formed by one needle bed, the two ground knitted fabrics are bound together by a tuck loop with only a binding yarn(s) constituted by a polyurethane based elastic fiber bare string(s) of 33 to 3000 decitexes, the binding yarn is bound to 25% or more of stitches of one of the front and back ground knitted fabrics having a lower stitch density, the ratio of the loop length of the binding yarn to the loop length of any one of the above described separate front and back circular knitted fabrics having a smaller loop length is in a range of 0.6 to 2.3, and the elastic knitted fabric has an air gap between the front and back ground knitted fabrics, and has a three dimensional structure;

(3) the elastic knitted fabric of (1), wherein the above described elastic knitted fabric is a circular knitted fabric with the separate front and back ground knitted fabrics each formed by one needle bed, the two ground knitted fabrics are bound together with only a binding yarn(s) constituted by a polyurethane based elastic fiber bare string(s) of 17 to 1500 decitexes, at last one of ground knitted fabrics are bound by a tuck loop to the binding yarn, the binding yarn is bound to 25% or more of stitches of one of the front and back ground knitted fabrics having a lower stitch density, the ratio of the loop length of the binding yarn to the loop length of any one of the above described separate front and back weft knitted fabrics having a smaller loop length is in a range of 0.2 to 0.6, and the elastic knitted fabric has a three-layer structure; and (4) the elastic knitted fabric of (1), wherein the above described ground knitted fabrics each has a warp-knitted structure, and the above described binding yarn is bound to 25% or more of stitches of one of the front and back ground knitted fabrics having a lower stitch density.

The elastic knitted fabrics described above may contain polyurethane based elastic fibers in the ground knitted fabrics. The inventors have devised an apparatus for changing a feed speed of spandex based elastic fibers on a knitting machine, and found a manufacturing process using the apparatus, thereby making it possible to provide an elastic knitted fabric having excellent stretchability, and being dense, light and excellent in shape stability, having a soft feel, and being most suitable for cloths worn by a person or used at a location close to the skin, general materials and sub-materials, which has not been achieved in the prior art. Thus, the inventors completed the present invention.

BEST MODE FOR CARRYING OUT THE INVENTION

The present invention will be described in detail below.

Figure 1:
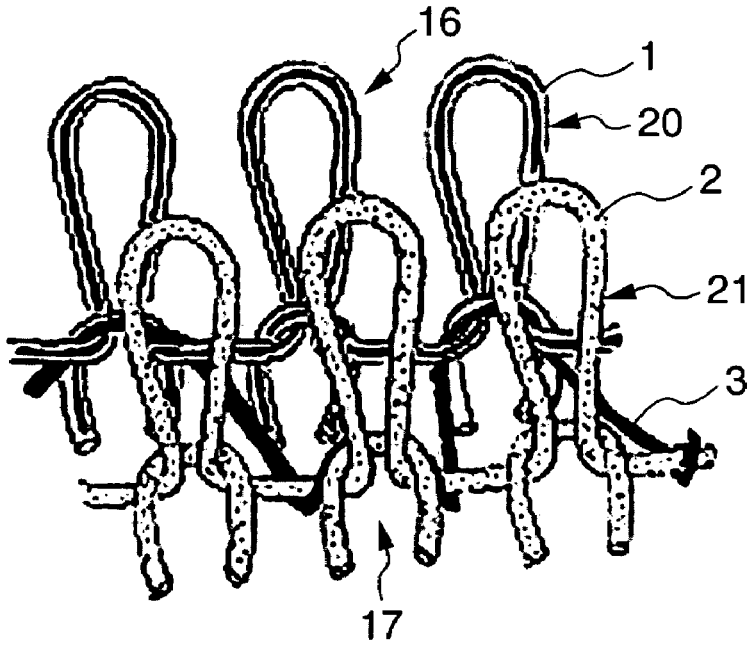
FIG. 1 is a loop diagram of a three-dimensional structure of the present invention.
Figure 2:
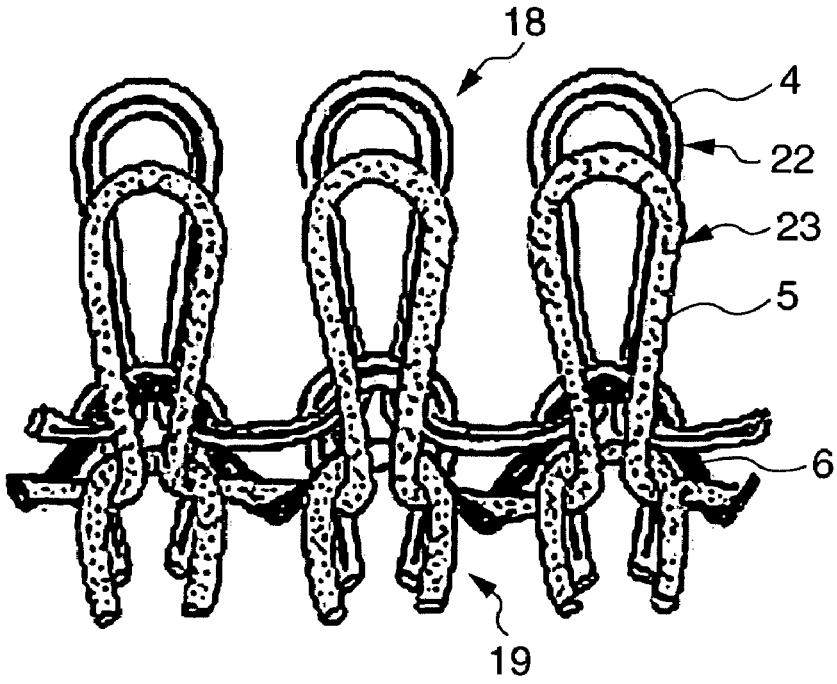
FIG. 2 is a loop diagram of a three-layer structure of the present invention.
Figure 7:
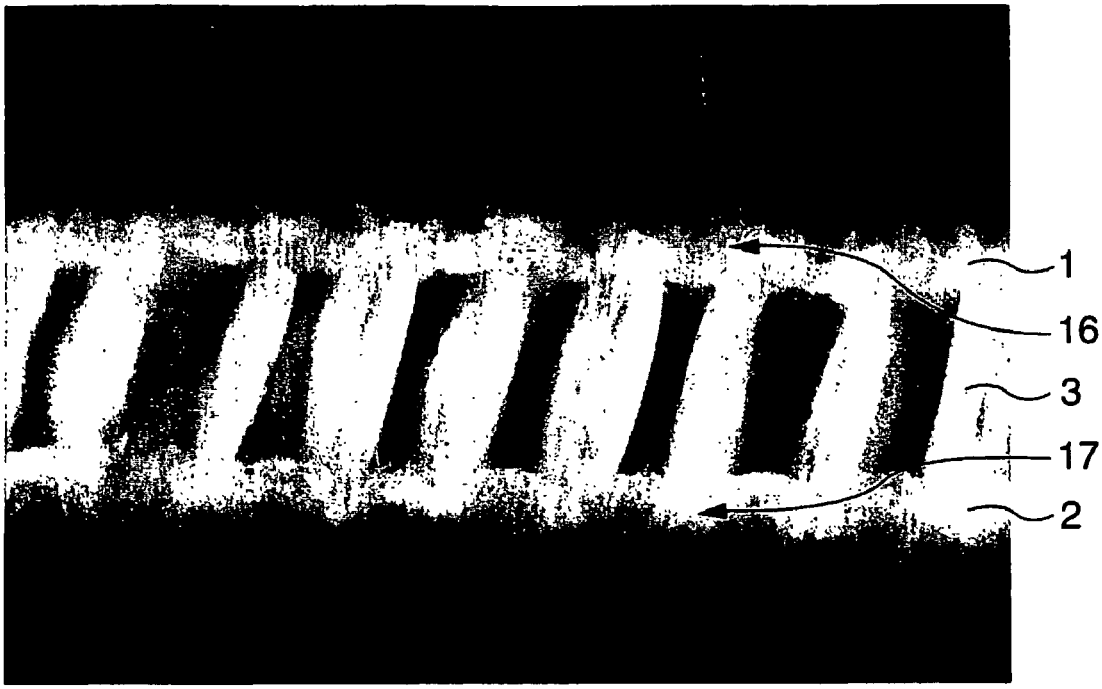
FIG. 7 shows a photographed cross section of the three-dimensional structure of the present invention.
Figure 8:
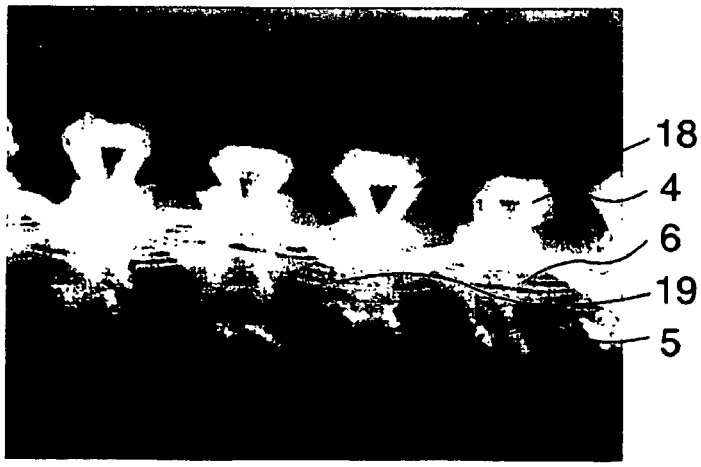
FIG. 8 shows a photographed cross section of the three-layer structure of the present invention.

In an elastic knitted fabric having a multilayer structure of the present invention, front and back ground knitted fabrics denoted by reference numerals 16 and 17 in FIGS. 1 and 7 and reference numerals 18 and 19 in FIGS. 2 and 8 are independently formed, and a binding yarn for binding the above described both ground knitted fabrics, denoted by reference numeral 3 in FIG. 1 and reference numeral 6 in FIG. 2, is made by only a bare string(s) of polyurethane based elastic fibers. The binding yarn for binding both the ground knitted fabrics is a bare string of polyurethane based elastic fibers, so that excellent stretchability can be added to a bound elastic knitted fabric having a multilayer structure without restricting elongation in warp and weft directions.

The size of the bare string of polyurethane based elastic fibers for use in the present invention is 17 to 3000 decitexes.

Further, for describing a preferred aspect of the present invention, an elastic knitted fabric of such a preferred aspect consists of the following three structures.

Figure 1A:
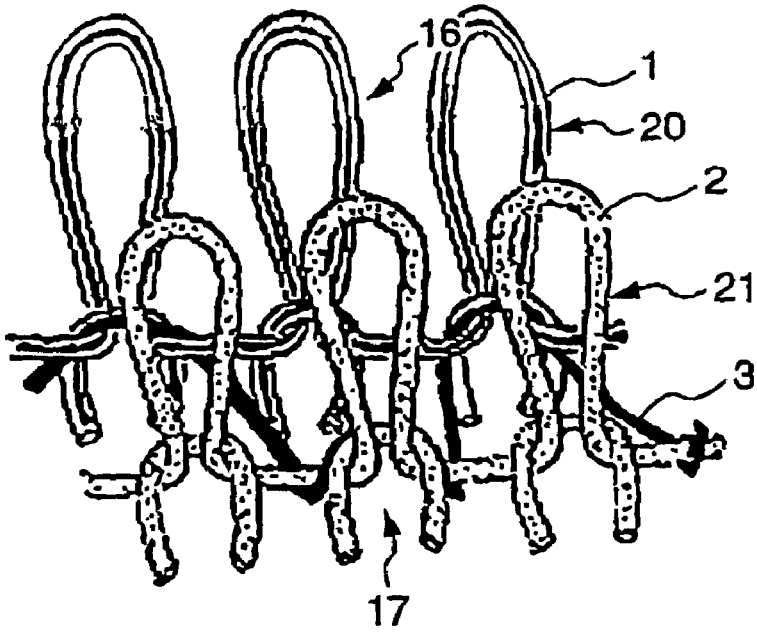
FIGS. 1A and 1B are loop diagrams of a three dimensional structure of the present invention showing one of the separate front and back ground knitted fabrics having a smaller loop length than the other.
Figure 1B:
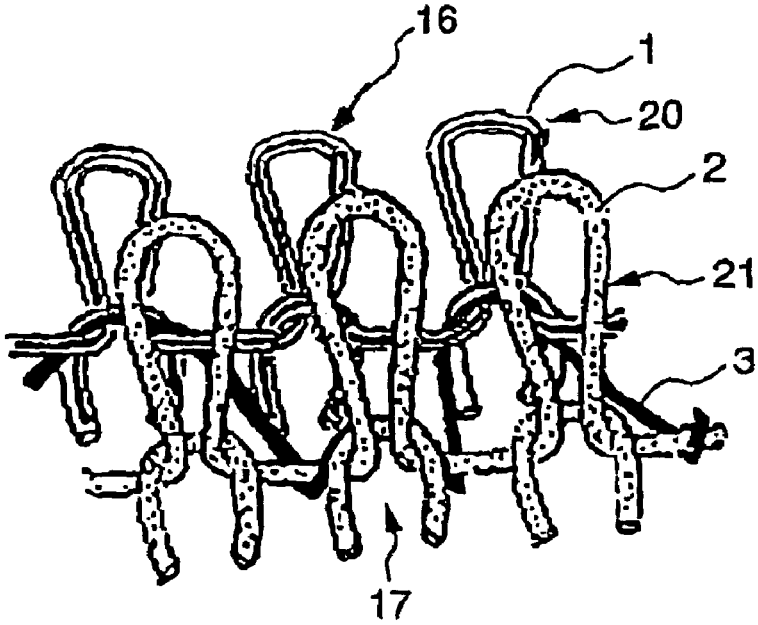

For the first preferred structure, separate front and back ground knitted fabrics are each independently formed by each needle bed of a circular knitting machine having two needle beds as shown in a loop structure diagram in FIG. 1. Both the ground knitted fabrics are bound together with only a bare string(s) of polyurethane based elastic fibers but in this case, the binding yarn is bound by a tuck loop to at least one of the ground knitted fabrics. By increasing the feed speed of the binding yarn, a three-dimensional structure having an air gap between front and back two ground knitted fabrics is formed. The binding yarn denoted by reference numeral 3 in FIG. 1 is bound to 25% or more of stitches of one of the front and back ground knitted fabrics having a lower stitch density, the ratio of the loop length of the binding yarn made of polyurethane based elastic fibers to the loop length of any one of the above described separate front and back circular knitted fabrics having a smaller loop length is in a range of 0.6 to 2.3. See FIGS. 1A and 1B. This is because by making the ratio of the loop length of the binding yarn to the loop length of the ground knitted fabric relatively large, the front and back two ground knitted fabrics are bound together with polyurethane based elastic fibers to form a three-dimensional structure having an air gap therein as shown by reference numeral 3 in FIG. 7. If this ratio (T) is smaller than 0.6, a problem may arise in terms of compressibility, recoverability and knitting characteristics of the obtained three-dimensional knitted fabric. The ratio (T) is preferably equal to or smaller than 2.3 in obtaining a three-dimensional knitted fabric having a good feel, and if the ratio is greater than 2.3, a bare string of polyurethane based elastic fibers may protrude from the front and back knitted fabrics to compromise the quality of the knitted fabric. In the present invention, the binding of ground knitted fabrics with a bare string of polyurethane based elastic fibers is performed by tuck knitting with at least one of the front and back ground knitted fabrics, but as for the number of bindings, the string is preferably bound to 25% or more of stitches of one of the front and back ground knitted fabrics having a lower stitch density.

The size of a bare string of polyurethane based elastic fibers to be used is preferably in a range of 33 to 3000 decitexes, more preferably 70 to 2000 in terms of the three-dimensional shape retaining property, recoverability from compression and resistance to flattening by repeated fatigues. If the size is smaller than 33 decitexes, the three-dimensional shape cannot be retained in the three-dimensional structure elastic knitted fabric of the present invention with a weak shearing force, and it may be impossible to obtain satisfactory recoverability from compression. If the size increases to more than 3000 decitexes, the weight of the elastic knitted fabric itself may become too large for use in cloths and the like.

Furthermore, the break elongation of the bare string of polyurethane based elastic fibers is preferably 400 to 1100%, and the dry heat processing temperature for presetting or the like during dyeing is preferably around 190° C. so that stretchability is not compromised.

In the present invention, for the method for binding ground knit fabrics with a bare string(s) of polyurethane based elastic fibers, one side may be bound by a tuck loop and the other side may be bound by a knit loop, but both the ground knitted fabrics are preferably tuck-bound for obtaining a stretchable knitted fabric having a bare string(s) of polyurethane based elastic fibers bound without affecting front and back knitted fabrics, allowing promotion of reduction in the thickness of the ground knitted fabric, having excellent elongation recoverability, having a good feel, and being excellent in form stability and surface quality.

Furthermore, if non-elastic fibers are contained in a binding yarn for binding front and back ground knitted fabrics together, compressibility or compression recoverability and the feel are compromised.

The method for knitting a bare string(s) of polyurethane based elastic fibers for use as a binding yarn is not limited, but for obtaining good fabric thinness feeling and elongation recoverability, zigzag binding in which the binding ratio of the ground knitted fabric to the number of stitches is 50% is preferable because an appropriate air gap is retained between front and back ground knitted fabrics and the three-dimensional shape is excellently retained. Furthermore, it is preferable that both the ground knitted fabrics are tuck-bound and the number of bindings to the front weave equals the number of bindings to the back weave because the surfaces of the front and back ground knitted fabrics of the elastic knitted fabric are flattened.

The term "having a three-dimensional structure" in the present invention means that front and back two ground knitted fabrics are substantially in a non-contact state, and the front and back two ground knitted fabrics are columnwise supported by a bare string(s) of polyurethane elastic fibers to retain an air gap between the two ground knitted fabrics.

An example of a process for manufacturing an elastic knitted fabric having a three-dimensional structure of the present invention will now be described.

As a knitting machine, the so-called double knit circular knitting machine having a normal two-row needle bed, which preferably has a large number of yarn feeding ports and a feeder capable of feeding a plurality of strings at a time, is preferably used. The gage of the knitting machine may be selected as appropriate according to an intended purpose, but a 18 to 40 gage knitting machine is usually used. Other than the gage double knit circular knitting machine, for example, a 42 gage knitting machine may be used as a 21 gage-equivalent machine with a needle being drawn out on one-by-one basis. Furthermore, a circular knitting machine having a gage rougher than the 18 gage may be used but in this case, it is preferable that a bed having a gage rougher than the 18 gage is limited to one of a dial bed and a cylinder bed, and the other bed has a 18 gage or higher for obtaining a dense and light knitted fabric desired in the present invention.

The thickness of the yarn used in front and back knitted fabrics, and denoted by reference numerals 1 and 2 in FIG. 1 and reference numerals 4 and 5 in FIG. 2 is not specifically limited, but the gross size is preferably in a range of 22 to 1220 decitexes, more preferably 34 to 310 decitexes. The size of a single yarn is preferably in a range of 0.1 to 610 decitexes, more preferably 1 to 100 decitexes.

The front and back ground knitted fabrics are not specifically limited, but they are preferably knitted weaves formed by one needle bed of a circular knitting machine, and are for example basic weaves of plain knitting, and derivative weaves of tuck knitting, float knitting, half cardigan stitch, lace knitting, platting knitting and the like.

As shown in the loop structure diagram in FIG. 2, a second preferred structure in the present invention has a knitted weave similar to that of the first structure described above, but is characterized in that the binding yarn is bound to 25% or more of stitches of one of the front and back ground knitted fabrics having a lower stitch density, and the ratio of the loop length of the binding yarn constituted by polyurethane based elastic fibers to the loop length of one of the above described separate front and back circular knitted fabrics having a smaller loop length is 0.2 to 0.6. See FIGS. 1A and 1B. The ratio of the loop length of the binding yarn constituted by polyurethane based elastic fibers to the loop length of the ground knitted fabric consisting of a circular knitted structure is relatively small, and the front and back two ground knitted fabrics are bound together with polyurethane based elastic fibers to form a three-layer structure. In this case, the size of a bare string of polyurethane base elastic fibers to be used is preferably in a range of 17 to 1500 decitexes, more preferably 22 to 640 decitexes in terms of stretchability, the surface quality of the knitted fabric.

Furthermore, the break elongation of the bare string of polyurethane based elastic fibers is preferably 400 to 1100%, and the dry heat processing temperature for presetting or the like during dyeing is preferably around 190° C. so that stretchability is not compromised. Furthermore, in the present invention, the ratio of the loop length of the bare string of polyurethane based elastic fibers as a binding yarn to the loop length of one of front and back weft knitted fabrics having a smaller loop length, specifically the ratio to either the loop length of cylinder stitches constituting one face or the loop length of dial stitches constituting the other face, which is smaller, is preferably 0.2 to 0.6, more preferably 0.2 to 0.5. If the ratio of the loop length of the bare string of polyurethane based elastic fibers is smaller than 0.2, the elongation of elastic fibers in the knitted fabric increases, so that yearn breaking and degradation in the surface quality of the substrate occurs during knitting, and elastic fibers are easily drawn out of the end surface of the knitted fabric, and a problem may arise if it is repeatedly worn and elongated as a cloth. If the ratio of the loop length is greater than 0.6, front and back knitted fabrics cannot be brought into close contact with each other, so that the fabric thinness is degraded, and the elongation of elastic fibers in the substrate drops so that elongation recoverability may be compromised. The ratio of the loop length described herein refers to the ratio of the length L-c in a relaxed state of the binding yarn to the length L-g of a yarn constituting the ground knitted fabric equivalent to one course deknitted and taken out from the knitted fabric having a fixed width (L-c/L-g).

In this structure, the binding of ground knitted fabrics with a bare string(s) of polyurethane based elastic fibers is performed by tuck-knitting with at least one of the front and back ground knitted fabrics. As for the number of bindings, the string is bound to 25% or more of stitches of one of the front and back ground knitted fabrics having a lower stitch density. For obtaining satisfactory fabric thinness feeling and elongation recoverability, zigzag binding in which the binding ratio of the ground knitted fabric to the number of stitches is 50% is superior and preferable. Furthermore, it is preferable that the binding of the binding yarn to both the front and back ground knitted fabrics is tuck binding, and the number of bindings to the front ground knitted fabric equals the number of bindings to the back ground knitted fabric because the appearance of a flat elastic knitted fabric is obtained.

A third preferred structure in the present invention is a multilayer elastic warp knitted fabric made by binding together separate front and back ground knitted fabrics, characterized in that the above described two-layer ground knitted fabrics consist of a warp knitted structure, the ground knitted fabrics are bound with only a bare string(s) of polyurethane based elastic fibers of 17 to 3000 decitexes, and the binding yarn is bound to 25% or more of stitches of one of the front and back ground knitted fabrics having a lower stitch density.

Figure 3:
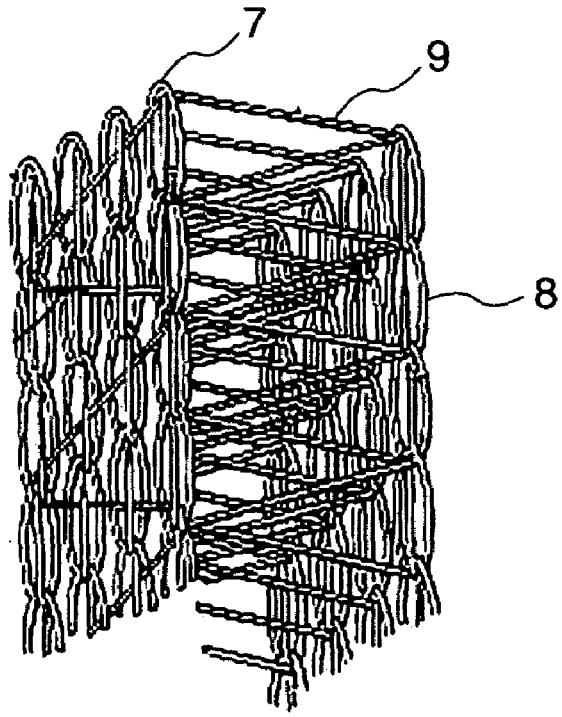
FIG. 3 is a loop diagram of a Russell structure of the present invention.

One example of the elastic warp knitted fabric of the present invention is shown in FIG. 3. The elastic warp knitted fabric can be knitted by a warp knitting machine having a two-row needle bed. That is, front and back two ground knitted fabrics 7 and 8 of the elastic warp knitted fabric having a multilayer structure, of the present invention, has a warp knitted structure, and may be any of a chain-knitted fabric, a 1×1 tricot stitch fabric, a cord-knitted fabric, a mesh-knitted fabric and the like. It may be a combination of a broad stitch with the front knitted fabric and the back knitted fabric. The ground knitted fabrics can be connected together with only a bare string(s) of polyurethane based elastic fibers 9 to obtain the elastic warp knitted fabric of the present invention.

In the present invention, the binding of ground knitted fabrics with a bare string(s) of polyurethane based elastic fibers may be knit loop binding or may be tuck loop binding. The former is preferable in the case of the three-layer warp knitted structure having a shape with front and back ground knitted fabrics bound together, and any of knit loop binding and tuck loop binding may be employed in the case of the three-dimensional structure having an air gap between front and back ground knitted fabrics. For the number of bindings, the binding yarn is bound to 25% or more, preferably 50% or more, of stitches of one of front and back ground knitted fabrics having a lower stitch density.

The size of a bare string of polyurethane based elastic fibers to be used is preferably in a range of 33 to 3000 decitexes, further preferably 70 to 2000 decitexes in terms of the three-dimensional shape retaining property, recoverability from compression, resistance to flattening by repeated fatigues, and the like. If the size is smaller than 33 decitexes, the three-dimensional shape cannot be retained in the three-dimensional structure elastic knitted fabric of the present invention with a weak shearing force, and satisfactory recoverability from compression cannot be obtained. If the size increases to more than 3000 decitexes, the weight of the elastic knitted fabric itself becomes too large for use in cloths and the like.

In the present invention, at least one of front and back ground knitted fabrics preferably contains an elastic composite yarn for further improving the elastic knitted fabrics having the multilayer structures of the three types described above and meeting the object. The elastic composite yarn described here refers to yarns with polyurethane based elastic fibers and non-elastic yarns combined in a variety of ways, which include, for example, a composite yarn covering-processed, for example, with polyurethane based elastic fibers as a core and polyamide long fibers as a sheath, and a core spun yarn using polyurethane based elastic fibers as a core surrounded by short fibers such as cotton to form a spun yarn.

By incorporating an elastic composite yarn in at least one of front and back ground knitted fabrics, stretchability can be added to the multilayer elastic knitted fabric of the present invention. Stretchability in the width direction of the knitted fabric by the binding yarn is supplemented, and stretchability can be also added in the length direction of the knitted fabric, so that a multilayer structure elastic knitted fabric having satisfactory stretchability in both warp and weft directions is provided. By making the stitch of the ground knitted fabric smaller and denser with a elongation recovery force of the elastic yarn, the connection yarn can be tightly bound thereto, thus making it possible to provide a stable multilayer structure. Furthermore, if the density of the entire ground knitted fabric is increased with the elastic yarn, the density of the connecting yarn is also increased, and a binding angle between the ground knitted fabric and the connecting yarn becomes closer to a right angle in the case of the elastic knitted fabric having a three-dimensional structure, resulting in an improvement in compression resilience and recovery rate.

If the elastic composite yarn is knitted into one of front and back two ground knitted fabrics, the above-described effect can be obtained. It is preferable that the composite yarn is knitted into both the ground knitted fabrics, because the balance of the knitted fabric is improved in the front and back fabrics, and phenomena such as the so-called curling such that the ear part or end part of the knitted fabric is curled up can be eliminated. Furthermore, the elastic composite yarn may form the ground knitted fabric by itself, may be arranged with another non-elastic yarn to form stitches, or may be cross-knitted with the non-elastic yarn.

In the elastic knitted fabric having a multilayer structure, of the present invention, the case will be described where both front and back ground knitted fabrics contain polyurethane based elastic fibers as a bare string(s), and the bare string(s) of polyurethane based elastic fibers and the non-elastic yarn are arranged to form stitches. In this case, like the elastic knitted fabric containing the elastic composite yarn, stretchability can be added to the multilayer elastic knitted fabric. Stretchability in the width direction of the knitted fabric by the binding yarn can be supplemented, and stretchability can also be added in the long direction of the knitted fabric, so that a multilayer structure elastic knitted fabric having satisfactory stretchability in both warp and weft directions is provided. By making stitches of the ground knitted fabric smaller and denser with a elongation recovery force of the elastic yarn, the density of the binding yarn is increased, and a crossing angle (binding angle) between the ground knitted fabrics 16 and 17 and the binding yarn 3 becomes closer to 90°, thus making it possible to improve the compression resilience and recovery rate of the elastic knitted fabric having a three-dimension structure.

By using a bare string of polyurethane elastic yarn as a binding yarn, the fiber pack density of a binding site located in the middle of the three-dimensional structure drops so that a space expands. That is, the bare string(s) of polyurethane elastic yarn is formed into a monofilament in such a manner that several single strings are fusion-bound, and therefore a space in the air gap of the binding site is large. On the other hand, in the case of a composite elastic yarn using the polyurethane elastic yarn as a core, covered with mono or multi-non-elastic fibers, the composite elastic yarn itself thickens, or covering fibers expands in a connecting site with expansion/contraction of the polyurethane elastic yarn and as a result, a space in the air gap is lessened. By using a bare string of polyurethane elastic yarn as a binding yarn, the air permeability of the entire knitted fabric is considerably improved, and weight saving can be achieved. Further, by using a bare string of polyurethane elastic yarn as a connecting yarn, the contact area of connecting yarns decreases in the connecting site, and thus the heat conductivity drops, and a large amount of air layer is contained, resulting in an improvement in heat retaining property of the entire knitted fabric.

The bare string of polyurethane elastic yarn described herein is a yarn produced in such a manner that a spinning stock solution is extruded into a spinning chamber through one or more spinnerets, converged and fusion-bound in contact sites of single strings, for example, and wound up in a state of a monofilament on the surface, and a covered elastic yarn with the bare string covered with a non-elastic fiber multifilament or the like, and a core spun yarn spun with short fibers such as cotton are exceptions.

The content of polyurethane based elastic fibers (denoted by reference numerals 20 and 21 in FIG. 1 and reference numerals 22 and 23 in FIG. 2, although those denoted by reference numerals 21 and 23 in the figures cannot been seen behind the non-elastic yarn) in front and back two ground knitted fabrics is preferably not less than 2% and not more than 60%, more preferably not less than 4% and not more than 20%, based on the non-elastic yarn in the same knitted fabric. As the content of polyurethane based elastic fibers decreases, a stretch performance of the entire knitted fabric is reduced. If the content of elastic yarn is less than 2%, the amount of elastic yarn is so small that the stretch performance of the entire knitted fabric may be reduced. Therefore, sufficient stretchability is hard to be added to the entire knitted fabric, and if the content is greater than 60%, the density of the knitted fabric becomes so high that the mass per unit area may excessively increase to compromise the air permeability. If the content of elastic yarn is not less than 4% and not more than 20%, an optimum knitted fabric having stretchability, being soft and having an appropriate tension and drape property can be obtained.

If formation of stitches with the bare string of polyurethane based elastic fibers in the ground knitted fabric is continuous, plain-knitted weaves are formed with the bare string but in this case, bare strings contact each other at a contact point of stitches in a loop-nodal manner, and the ground knitted fabric is heat-sealed in set processing during refine dye-finishing and dyeing, and thus the so-called run such that stitches are deknitted from the end of the substrate never occurs even if the ground knitted fabric is knitted by plain knitting or chain knitting. Further, the binding yarn contacts the bare string of polyurethane based elastic fibers at a nodal site of the binding yarn and the ground knitted fabric, and if refine dye-finishing is similarly performed in this state, the above described contact site is heat-sealed in dry heat setting and wet heat processing during dyeing. In this case, the knitted fabric is free from a weave shift and stable even if the entire knitted fabric is distorted and stressed. In the case of the elastic circular knitted fabric having a three-dimensional structure, a resilient force of polyurethane is transmitted quickly throughout the knitted fabric to improve the instant resilience of the knitted fabric. In the case of the elastic circular knitted fabric having a three-dimensional structure, the resilience from compression along the thickness of the three-dimensional structure is improved, and deformation can be endured to recover the original shape even under a shearing force because the ground knitted fabric and the polyurethane based elastic fibers of the binding yarn are fusion-bound together in front and back ground knitted fabrics. Further, when a knitted fabric is formed into a cloth, it has been conventionally required that the ends of the knitted fabric are sewn together by a sewing machine or the like. However, the knitted fabric of the present invention can be used for a cloth in a cut state because the polyurethane fibers of the ground knitted fabric and the binding yarn are fusion-bound together. In this case, the bare string of polyurethane elastic yarn should be knitted into both front and back ground knitted fabrics. Further, for the problem such that the binding yarn easily falls out from the stitch due to expansion/contraction at the time of wearing the knitted fabric, the bare string of polyurethane elastic yarn is preferably knitted into the ground knitted fabric, and further preferably into both the ground knitted fabrics. In this way, the bare string of polyurethane based elastic fibers is knitted into the front and back two ground knitted fabrics, resulting in many advantages given to the elastic circular knitted fabric having a three-layer structure and the elastic circular knitted fabric having a three-dimensional structure. Here, if a non-elastic heat seal yarn and thermoplastic synthetic fibers such as polyester are heat-sealed in the three-dimensional structure, the entire knitted fabric is hardened, and bending rigidity increases, so that the knitted fabric can hardly be worn by a person or used at a location close to the skin, as described previously. However, if polyurethane elastic fibers are fusion-bound together, a binding point is fixed, but the yarn itself expands and contracts, and therefore the knitted fabric as a whole has stretchability, is soft and has an appropriate tension and drape.

The case will now be described where only one of front and back ground knitted fabrics has polyurethane based elastic fibers as a bare string and a non-elastic yarn arranged to form stitches, and both the ground knitted fabrics are bound together with the bare string(s) of polyurethane based elastic fibers. In this case, since the front and back knitted fabrics have different expansion/contraction powers, and the expansion/contraction power of the ground knitted fabric containing polyurethane based elastic fibers is greater than that of the other ground knitted fabric, a problem arises such that curling of the substrate occurs with the ground knitted fabric of greater expansion/contraction power being inside, thus making it impossible to obtain a practical elastic knitted fabric. Particularly, this disadvantage occurs in the three-dimensional structure elastic circular knitted fabric, but is especially significant in the three-layer elastic circular knitted fabric. Thus, when the bare string of polyurethane based elastic fibers in one ground knitted fabric is knitted, the size of the binding yarn should be greater than the size of polyurethane based elastic fibers of the ground knitted fabric for alleviating the unbalance of knitted fabric expansion/contraction powers. The present inventors have conducted vigorous studies on this problem, and found that if the ratio (D-c/D-g) of the size (D-c) of binding polyurethane based elastic fibers to the size (D-g) of polyurethane based elastic fibers in the ground knitted fabric is 2 or greater, curling of the substrate is alleviated, and the ratio of 3 or greater is further preferable, thus making it possible to provide a three-layer structure elastic circular knitted fabric capable of being practically used.

The compression performance and the compression recoverability of the elastic circular knitted fabric and the elastic warp knitted fabric having a three-dimensional structure, of the present invention, vary depending on the thickness of the elastic knitted fabric and the size of the elastic yarn used for the binding yarn 3. That is, as the size of the elastic yarn used for the binding yarn 3 increases, the compression performance and the compression recoverability are improved, while as the thickness of the elastic knitted fabric increases, the compression performance and the compression recoverability are reduced.

In the present invention, a ratio between the gross size (D) (decitex) of the binding yarn 3 bound in any area of 1 $cm^2$ in the ground knitted fabric and the thickness (T) (mm) of the knitted fabric of the area preferably meets the requirement of $5\times10^3 \leqq D/T \leqq 5\times10^5$. If $5\times10^3 > D/T$ holds, it may be impossible to achieve a sufficient improvement in compression performance and compression recoverability, while if $D/T > 5\times10^5$ holds, the compression resistance and the bending rigidity of the entire knitted fabric tend to increase, so that generally, use by a person around his or her body may involve some difficulty.

In the case of the elastic circular knitted fabric having a three-dimensional structure, the binding yarn is bound to the stitch of the ground knitted fabric by tuck knitting. In the case of the elastic warp knitted fabric having a three-dimensional structure, the binding yarn is bound to the stitch of the ground knitted fabric by knit sewing and/or tuck knitting. The rate (R) of stitches bound to the connecting yarn, of stitches in an area of 1 $cm^2$ at any site of front and back two ground knitted fabrics, is preferably 25% or greater. If the rate (R) of the stitches is less than 25%, the number of strings of connecting yarn decreases, so that it may be impossible to obtain a sufficient resilience and recovery rate. By increasing the size of the connecting yarn to be used, the compression resilience and recoverability are improved, but irregularities may occur on the surface of the ground knitted fabric due to the connection to compromise the flatness of the surface of the substrate.

Except for the case where the connecting yarn and the ground knitted fabric are bound at all stitches, the pattern in which the connecting yarn is connected to the stitch of the ground knitted fabric is different for each of any courses. However, for example, if the ground knitted fabric is connected to the connecting yarn at odd-number stitches in an alternate manner in any course, and the ground knitted fabric is connected to the connecting yarn at even-number stitches in an alternate manner in the next course, the surface of the ground knitted fabric becomes uniform, and the compression resilience and recovery rate become uniform for each knitted fabric site, which is preferable. The phase of the connecting site is shifted for each knitting course, and this is repeated to obtain a satisfactory knitted fabric.

Then, as a result of conducting vigorous studies on elongation characteristics of the substrate following the elongation of the skin associated with a motion of a person, the present inventors have found an elastic knitted fabric having a multilayer structure characterized in that the elongation in each of warp and weft directions is 80 to 150% under a load of 3.5 N/cm, and 100 to 200% under a load of 9.8 N/cm, an elongation ratio (A) and an elongation ratio (B) in warp and weft directions, expressed by the following equations (1) and (2), are both in a range of 0.8 to 1.2.

$$\text{Elongation ratio } (A) = \text{elongation (\%) in warp direction under load of 3.5 N/cm} \div \text{elongation in weft direction (\%)} \quad (1)$$

$$\text{Elongation ratio } (B) = \text{elongation (\%) in warp direction under load of 9.8 N/cm} \div \text{elongation in weft direction (\%)} \quad (2)$$

That is, the present inventors have found that a stress in the elongation direction when the motion of the person along the body height is followed to elongate the substrate and a stress of the substrate in the circumference direction of the human body significantly affect the wear feeling; and if a predetermined elongation is provided in both warp and weft directions of the knitted fabric, an elastic knitted fabric excellent in motion following characteristics and detachability and comfortable for wearing can be obtained; and by inhibiting an unnecessary elongation of the substrate, durability of the substrate can be improved. Thus, the present inventors achieved the present invention.

The elongation described above refers to a value measured with a monoaxially fixed biaxial tensile tester (STRIP BIAIAL TENSILTESTER KES-G2-SB1 manufactured by Kato Tech Co., Ltd.). The substrate is restrained in one direction and the substrate elongation in the other direction is measured, thus making it possible to measure the elongation for practical use. Incidentally, since the conventional elongation measurement method is such that a measurement is made with only the elongation direction fixed and other directions not restrained, it has a disadvantage that the substrate width changes at the middle of the grip, thus making it impossible to measure a change in stress in two directions covering the cloth width at the time of wearing.

The load of 3.5 N/cm according to the present invention corresponds to the power with which a person of average power may pull the fabric when he or she wears it. The feeling of the soft power or hard power in the circumference direction of the person varies depending on product concepts and personal preferences, but if the elongation in the warp direction of the elastic knitted fabric under the load of 3.5 N/cm is less than 80%, elongation of the substrate is generally insufficient, thus requiring an excessive force for wearing and taking off the fabric. On the other hand, if the elongation in the weft direction is less than 80%, one feels strained because the skin elongation in the elongation direction in a lie motion is maximum 50%, and if the fabric is worn as a girdle, unpleasantness is brought about such that a waist line or the lower end of the femor is shifted. Furthermore, if the elongation in each of warp and weft directions of the elastic knitted fabric is greater than 200% under the load of 3.5 N/cm, expansion/contraction fatigues of the elastic yarn become so significant that durability is compromised and the strength of the substrate is reduced.

The load of 9.8 N/cm corresponds to the utmost extended elongation of the substrate and to the power causing an accident of breaking through the substrate by a consumer. For preventing such an accident, the utmost extended elongation should be reduced to 200% or smaller to prevent the substrate from being roughened. From this point of view, the smaller the elongation under the load of 9.8 N/cm, the better, but an elongation of 100% or greater under the load of 9.8 N/cm is required for ensuring comfort at the time when wearing and taking off the fabric. It has been found that if the ratio of the elongation is 0.80 or less, elongation in the weft direction is greater than elongation in the warp direction, and if the balance of the elongation is 1.200 or greater, elongation in the warp direction is greater than elongation in the weft direction, thus making it difficult to obtain a comfort wearing feeling.

Preferably, the knitted fabric in which the binding yarn 6 is bound to both ground knitted fabrics at tuck weaves is excellent in stability, which is free from a curling phenomenon such that the ear part is curled up when being cut. Further, in the conventional knitted fabric, the power can be different only for warp and weft directions, but by knitting a fabric with the tuck weave of the present invention, power-up in the course direction alone is made possible, and the warp/weft ratio of the elongation and power can be in a range of 0.8 to 1.2.

The polyurethane based elastic fibers for use in the present invention include not only polyurethane elastic fibers but also polyether ester based elastic fibers. For the polyurethane elastic fibers, for example, dry-spun fibers or melt-spun fibers can be used, and polymers and spinning processes are not specifically limited. The size of fibers is usually 17 to 3000 decitexes, preferably 22 to 620 decitexes. The break elongation is preferably 400% to 1200% for obtaining fibers excellent in stretchability. Further, it is preferable that stretchability is not compromised at around 180° C. which is a normal processing temperature in a preset step during dyeing.

The polyurethane elastic fibers include, for example, but not limited to, polyurethane elastic fibers comprised of a copolymerized polyalkylene ether diol, an aromatic diisocyanate mainly composed of 4,4-diphenylmethane diisocyanate, and a polyurethane obtained from bifunctional diamine, in which the number average molecular weight of the urethane part of the polyurethane is 6000 to 9500, the number average molecular weight of the urea part is 650 to 950, the 300% modulus is 0.20 g/decitexes or less.

The non-elastic yarn constituting the front and back ground knitted fabrics of the three-dimensional knitted fabric of the present invention may be any of a filament yarn and a spun yarn. Specifically, filament yarns include preferably yarns composed of synthetic fibers such as viscose rayon, cupra rayon, acetate fibers, polyamide fibers, polyester fibers, polytrimethylene terephthalate fibers, acryl fibers, polypropylene fibers and vinyl chloride fibers. The form of these fibers may be any of a unprocessed gray yarn, a false twist finished yarn, a colored yarn and the like, or may be a composite yarn thereof. Spun yarns include preferably yarns using short fibers composed of natural fibers such as cotton, wool and hemp, and synthetic fibers such as viscose rayon, cupra rayon, acetate fibers, polyamide fibers, polyester fibers, acryl fibers, polypropylene fibers and vinyl chloride fibers, and may be single yarn or mixed yarn.

The gross size of a yarn that is used for forming front and back ground knitted fabrics is preferably in a range of 22 to 1220 decitexes, more preferably 33 to 310 decitexes. The size of a single yarn is preferably in a range of 0.1 to 310 decitexes, more preferably 0.2 to 20 decitexes.

The elastic knitted fabric having a multilayer structure, of the present invention, is characterized in that the elastic knitted fabric is easily subjected to heat molding. The multilayer structure elastic knitted fabric of the present invention having recessed portions and/or raised portions formed and fixed by heat molding preferably contains elastic fibers in the front or back ground knitted fabric, more preferably in both the front and back ground knitted fabrics. The mixing ratio of polyurethane elastic fibers in the knitted fabric is not limited, but is preferably 5 to 60% by mass. The knitted fabric containing elastic fibers on the front or back face is characterized in that mold processability is improved, stretchability can be added after molding, and the original shape is easily recovered even if the knitted fabric is deformed under an external pressure. The elastic fibers are preferably polyurethane elastic fibers, and may be identical to or different from polyurethane elastic fibers used for the binding yarn. In this way, the elastic knitted fabric having a multilayer structure, of the present invention, has the skeletal structure of the elastic knitted fabric formed by polyurethane based elastic fibers, and is therefore easily subjected to irregularity imposition processing due to the heat fixation performance of polyurethane based elastic fibers, and an irregular form after imposition processing persists. This characteristic is particularly remarkable in the elastic knitted fabric with a three-dimensional structure having an air gap between front and back two ground knitted fabrics, and the elastic knitted fabric with a three-dimensional structure is excellent in irregularity-retaining properties owing to its rigidity. Of course, the non-elastic yarn constituting the ground knitted fabric is preferably composed of polyester fibers excellent in thermoplasticity, polypropylene fibers having a relative low melting point, or the like. The front and back knitted fabrics may be separately formed with these elastic yarns having different thermal characteristics. For example, a knitted fabric with the back face cured like a resin and the front face having a soft feel giving comfort to the human skin is obtained depending on the temperature and time during imposition-type processing.

The gray fabric of the multilayer structure elastic knitted fabric is capable of being opened, subjected to preprocessing, then undergoing a dyeing step and undergoing a finish set including resin processing.

The multilayer structure elastic knitted fabric of the present invention is characterized in that a recessed portion or raised portion is formed and fixed by heat molding. The method for carrying out heat molding is not limited. If an overheating plate is used, an elastic knitted fabric excellent in form fixation characteristics and excellent in recoverability for recovering the original shape even if the knitted fabric is recessed under an external force can be obtained.

As heat molding using an overheating plate, for example, the front face is placed on a desired concave female mold, and then pressed with a convex male mold from the back face, and both layer parts are heat-molded with the female mold previously heated to a high temperature and the male mold previously heated to a lower temperature than the female mold. It is preferable that the space between the female mold and the male mold is separated into required form-fixed thicknesses, and heat press molding is carried out. The heat molding temperature, the heat molding time, the heat molding interval and the like may be selected as appropriate according to a desired form.

The three-dimensional structure fabric of the present invention has a volume retaining factor of preferably 0.5 or-greater, more preferably 0.6 or greater. Where the mold volume of a mold for heat molding is A, and the mold volume of a heat-molded three-dimensional structure knitted fabric is B, the volume retaining factor is calculated as B/A. If the volume retaining factor of the heat mold form is less than 0.5, the form of the knitted fabric is not sufficiently retained after molding. For obtaining a mold product using such a three-dimensional knitted fabric, the elongation of the knitted fabric during heat molding should be increased, and therefore the step performance tends to be compromised such that yarn breaking easily occurs.

For example, a specimen of 30 cm (warp)×30 cm (weft) of the three-dimensional structure knitted fabric is taken and subjected to helmet-shaped male/female molding toward the center, whereby a helmet cushion material capable of being used as a core material of the helmet in a molded state and having a three-dimensional structure is obtained. Furthermore, a specimen of 20 cm (warp)×45 cm (weft) is taken and subjected to brassiere cup molding, and periphery is sewn by an over lock sewing machine leaving only a required part, whereby a sport brassiere can be obtained.

The three-dimensional structure knitted fabric of the present invention has independent front and back knitted fabrics, and therefore a desired knitted fabric can be obtained by changing a combination of materials used for the front and back knitted fabrics. If the front and back knitted fabrics are tuck-knitted using a connecting yarn composed of polyurethane elastic fibers, the knitted fabric, when used for a supporter, etc., may preferably alleviate the impact of an external force applied. The multilayer structure elastic knitted fabric of the present invention can be heat-molded into one part of a desired three-dimensional structure, and then bound to a different material (e.g. weave, knitted fabric, leather, vinyl chloride sheet, etc.) by sewing to be formed into a desired shape for use. Furthermore, it can be subjected to flocky processing to raise one or both faces for use.

In the elastic knitted fabric having a multilayer structure, of the present invention, a textile design can be given to the ground knitted fabric by jacquard knitting using a plurality of non-elastic yarns for the ground knitted fabric. Further, in the elastic circular knitted fabric and the elastic warp knitted fabric having a three-dimensional structure, of the present invention, front and back two ground knitted fabrics are partly bound in a contact state, whereby a three-dimensional site and a linear or planar three-layer structure site are formed and as a result, a three-dimensional design having irregularities can be given to the entire knitted fabric.

For giving a three-dimensional design to the surface of the ground knitted fabric, the feed amount of connecting yarn may be reduced at any site to substantially contact-bind front and back two ground knitted fabrics, or change the distance between the two ground knitted fabrics (thickness). Further, the non-elastic yarn for forming one ground knitted fabric may be used to form the other knitted fabric.

Further, the elastic knitted fabric of the present invention is such that the elastic circular knitted fabric having a three-dimensional structure, the elastic circular knitted fabric having a three-layer structure, and the three-dimensional site and the linear or planar three-layer structure site with the above elastic circular knitted fabrics combined are formed. As a result, a three-dimensional design having irregularities is given to the entire elastic knitted fabric of the present invention, which may be applied to a seamless formed cloth partly unopened and partly sewn in a cylindrical form. The present invention can implement a function required for each site of a cloth. That is, taking shorts for cycling as an example, a site corresponding to the saddle is three-dimensionally knitted, and a three-layer structure elastic circular knitted fabric of relatively high power is formed for a site around the waist.

The present invention also relates to a process for knitting a knitted fabric containing an elastic yarn, and particularly to a process for knitting an elastic circular knitted fabric characterized in that when at least two elastic yarn packages are fed from one yarn feeder in a circular knitting machine, bare strings of elastic yarn are fed at two or more different feed speeds.

Furthermore, the present inventors have found a process for manufacturing an elastic knitted fabric having a multilayer structure, characterized in that a feed speed (V-g) of a bare string of polyurethane based fibers knitting a ground knitted fabric is unequal to a feed speed (V-c) of a bare string of polyurethane based elastic fibers binding front and back knitted fabrics, and made an apparatus for implementing the process. In the active delivery process of delivering polyurethane based elastic fibers to knitting needles from a spool for bare strings of polyurethane based elastic fibers, mounted on one circular knitting machine, the strings are delivered at two or more different feed speeds, whereby a various knitted fabrics, especially elastic circular knitted fabrics having multilayer structures, which have not been achievable, can be obtained.

Further, the present inventors have found that by feeding the bare string of polyurethane based elastic fibers binding front and back ground knitted fabrics at a controlled draw ratio of 2 or less, a three-layer structure knitted fabric with front and back two ground knitted fabrics bound together as well as a three-dimensional structure elastic circular knitted fabric having an air gap between both the ground knitted fabrics can be manufactured.

The present inventors devised an apparatus for delivering a bare string of polyurethane based elastic fibers required for manufacturing the multilayer elastic circular knitted fabric of the present invention. Traditionally, the feeder proposed in JP-B-4-9222 has a pair of support rolls extending to the left and right of the main body (holder), is driven by a toothed tape associated with a knitting machine, and can freely rotate a plurality of elastic yarn packages on a pair of support-drive rolls attached to the holder.

In the apparatus, however, if there is only one toothed tape associated with the knitting machine, the feed amount of polyurethane based elastic fibers is all fixed. Thus, the present inventors devised a method for changing the feed amount of polyurethane based elastic fibers by increasing the number of toothed tapes. In this case, however, four packages of polyurethane based elastic fibers are placed in one feeder, thus raising a problem such that the feed amount is changed on a unit of four packages and thus the degree of freedom is limited. Thus, the inventors devised an apparatus capable of stably feeding strings at different rates from elastic fiber packages with one yarn feeder even if driven by one toothed tape. Specifically, it is a yarn feeder characterized in that a pair of cheese support-drive rollers extending in parallel to each other, rotatably supported on a holder, is so situated as to protrude in opposite directions from the holder, driving means for rotating the cheese support-drive roller is installed, and a pair of cheese support-drive rollers having different outer diameters is installed, and/or means for driving in variable speed a pair of cheese support-drive rollers in opposite directions is installed, so that the surface speeds of the cheese support-drive rollers are different for the opposite directions of the holder. The pair of cheese support-drive rollers has a through-hole in a cylinder core and has a part for fixation so that it is detachably fixed to a drive shaft. The yarn feeder is characterized by further comprising another pre-drawing roller rotating at a surface speed greater than that of the pair of cheese support-drive rollers rotating at the same surface speed.

The present invention proposes a method and an apparatus for feeding an elastic yarn for knitting an elastic knitted fabric in which two types should be fed at different speeds. Typical examples of conventional knitted fabrics made by cross-knitting elastic bare strings include plain-knitted fabric, but the knitted fabric is made by plain knitting the elastic yarn arranged with the non-elastic yarn. Furthermore, another example is a rib-knitted fabric but in this case, the elastic yarn forms a plain-knitted fabric with a dial needle. They each have one type of elastic yarn weave, and can be treated by a normal knitting machine with a single elastic yarn feeder without any problems. The present inventors invented an apparatus and method capable of feeding at different speeds along with the invention of a new weave requiring yarn feeding at different speeds.

That is, the elastic yarn feeder of the present invention is mainly mounted concentrically around a circular knitting machine, and can feed a bare string of elastic fibers wound in a cheese form to the knitting machine at a fixed speed while releasing and draw-controlling the string.

Figure 4:
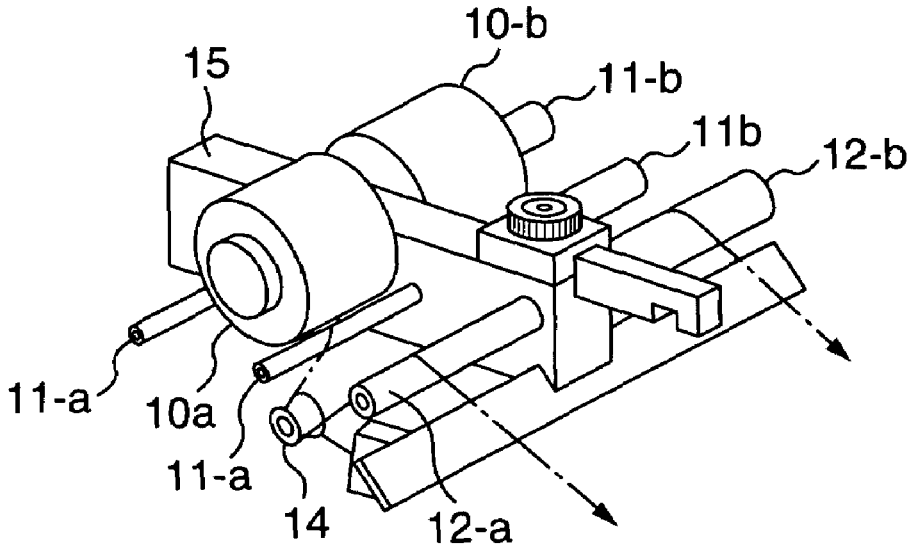
FIG. 4 is an outline drawing of a feeding apparatus for elastic yarn of the present invention.

The outline of the apparatus will be described specifically below with reference to FIG. 4.

Figure 5:
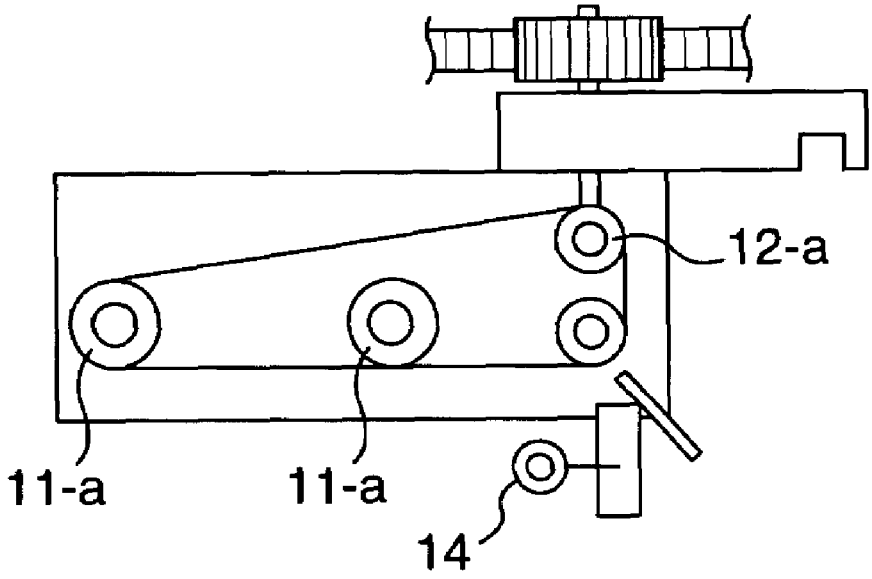
FIG. 5 is a holder side view of the feeding apparatus for elastic yarn of the present invention.
Figure 6:
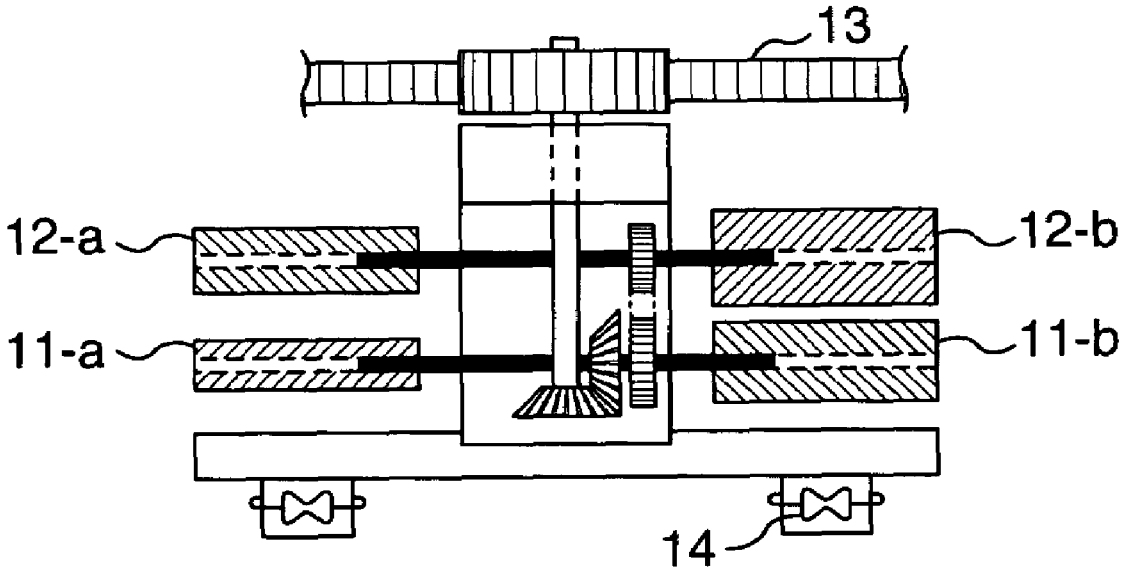
FIG. 6 is a holder front view of the feeding apparatus for elastic yarn of the present invention.

Furthermore, FIG. 5 is a sectional view of the interior of a holder 15 of a yarn feeder of the present invention seen from the side, and FIG. 6 is a front view of the yarn feeder of the present invention.

In the yarn feeder, a pair of package support-drive rollers (11-*a* and 11-*b*) extending in parallel to each other, rotatably supported on the holder (15) is so situated as to protrude in opposite directions from the holder (15), and a toothed belt (13) and a drive transmitting apparatus are installed as driving means for rotating the package support-drive roller. A pair of package support-drive rollers (11-*a*) and (11-*b*) have different outer diameters so that the surface speeds of the cheese support-drive rollers are different for the opposite directions of the holder. The pair of support-drive rollers has a structure such that a through-hole is provided in a cylinder core, so that the support roller can be fixed to a drive shaft, and a change can be made as appropriate for a different yarn speed ratio. Further, pre-draw rollers (12-*a*) and (12-*b*) rotating at a surface speed greater than that of the pair of package support-drive roller (11-*a*) or (11-*b*) are provided, and a yarn breakage sensor (14) is provided at a position between the package support-drive roller (11-*a*) and the pre-draw roller (12-*a*) at which the elastic yarn is draw-controlled after being released. The diameter of the package support-drive roller is 1 to 10 cm, and the ratio of the rotation speed of a high yarn speed roller to the rotation speed of a low yarn speed roller can be 10. Furthermore, the pre-draw roller (12-*a*) or (12-*b*) rotates at a surface speed greater by a factor of 1.2 to 2.0 than at least the corresponding cheese support-drive roller (11-*a*) or (11-*b*). Furthermore, reference symbols 10-*a* and 10-*b* each denote a package with a bare string of polyurethane based elastic yarn wound around a paper tube.

An effect of the present invention is described below: If an elastic feeder that has been generally used as shown in JP-B-4-9222 is used, a cost for additionally introducing a drive system and an apparatus installation space are required for feeding elastic yarns at different speeds as in conditions for knitting the multilayer structure knitted fabric of the present invention because the yarn speed is fixed. Furthermore, the elastic yarn is slightly adhesive, and thus often causes problems of release failure for high-speed releasing and low draft releasing. The present apparatus can solve the former problem at a low cost, and can solve the latter problem by installing a pre-draw roller.

The present invention will be specifically described below with Examples.

Physical properties for use in the present invention are measured as follows.

(1) Mass Per Unit Area

Measurements are made according to the test method of mass per square meter in JIS-L-1018.

(2) Thickness

KES-EB3 Compression Tester manufactured by Kato Tech Co., Ltd. is used. A sample is held between cupper plates each having a circular surface having an area of 2 $cm^2$ (compression speed 0.02 mm/sec), the thickness of the sample is measured at five points under a compressive pressure Pm of 0.5 $g/cm^2$, and the average of the measured values is calculated.

(3) Compressibility and Recovery Rate

Measurements are made according to JIS-L-1018. A three-dimensional knitted fabric is slit into a size of 2 cm×2 cm, one piece of slit fabric is placed on a measurement table, and a thickness A is measured when an initial load of 20 cN is applied to an area of 4 $cm^2$ along the thickness from above. Then, a load of 300 cN is applied to the area of 4 $cm^2$, a thickness B is measured after one minute, then the load is removed and the sample is left standing for one minute, and a thickness C is measured when the initial load is applied again. The measurement is repeated three times, a compressibility and a recovery rate are calculated according to the following equations, and the averages of the calculated values are determined.

$$\text{Compressibility (\%)}=\{(A-B)/A\}\times 100$$

$$\text{Recovery rate (\%)}=\{(C-B)/(A-B)\}\times 100$$

(4) Air Permeability

KES-F8-AP1 Air Permeability Tester manufactured by Kato Tech Co., Ltd. is used to measure an air flow resistance five times, and the average of the measured values is calculated.

(5) Feel of Substrate

A determination is made based on the results of sensory test by five monitors.

(6) Elongation and Elongation Recovery Rate

A knitted fabric is slit into a size of 2.5 cm×15 cm. An elongation recovery curve of elongation and recovery of the fabric is made under up to a maximum load of 9.8 N/cm with a holding length of 10 cm and at an elongation speed of 100%/minute using a constant speed elongation tester (Tensilon manufactured by Toyo Baldwin Co, Ltd.). An elongation under the load of 9.8 N/cm is read from this curve. Furthermore, elongation ratios are determined from the following equations.

Elongation ratio ($A$)=elongation (%) in warp direction under load of 3.5 N/cm+elongation (%) in weft direction Elongation ratio ($B$)=elongation (%) in warp direction under load of 9.8 N/cm+elongation (%) in weft direction The elongation recovery rate is determined, according to the following equation, from an elongation amount (c) under the load of 9.8 N/cm and an elongation amount (d) when the load under recovery equals 0.

$$\text{Elongation recovery rate (\%)}=(c-d)\times 100/c$$

(7) Elastic Fiber Draw Resistance

A knitted fabric is cut into a size having a length of 7.5 cm and a width of 2.5 cm with the warp direction as the direction of elastic fibers. Then, both sides of one elastic fiber at the center in the width direction is cut up to ⅓ in the warp direction, and the elastic fiber is taken out from the knitted fabric. Then, the elastic fiber is cut with scissors at a position of 2.5 cm in the substrate of the elastic fiber to fabricate a measurement specimen, and measurements are made under the following measurement conditions.

(Measurement conditions) The knitted fabric portion and the elastic fiber are each held by the constant speed elongation tester (Tensilon manufactured by Toyo Baldwin Co., Ltd.), and the elastic fiber is drawn at an elongation speed of 30 cm/minute. The resistance at this time is recorded, and the average of draw stress peaks is determined.

(8) Volume Retaining Factor

For the molding volume of a knitted fabric, a thermoplastic film (synthetic resin film softened with dry heat of 80 to 100° C.) is placed on the surface of a molded knitted fabric, the same mold shape is retained along a recessed or raised portion of the knitted fabric with dry heat air (a dryer set at a softening temperature), and then the thermoplastic film is fixed with cool air. Water is made to flow over the thermoplastic film retaining the shape of the recessed and raised portions of the knitted fabric to measure the volume.

The volume of a mold used for molding is a heat molding volume. The volume of the molded knitted fabric is measured, and the volume retaining factor is calculated according to the following equations.

Volume retaining factor=(molding volume retained by molded knitted fabric)/(heat molding volume)

EXAMPLE 1

A polyester false twist finished yarn of 84 decitexes and 30 filaments (TECHNOFINE® manufactured by Asahi Kasei Corporation) was used as a yarn for use in a front knitted fabric and a back knitted fabric of a three-dimensional knitted fabric to form a knitted fabric into plain stitch. A bare string of polyurethane based elastic fibers of 155 decitexes (ROICA® manufactured by Asahi Kasei Corporation) was used as a yarn for binding the front and back knitted fabrics together.

Bind-knitting was performed with all the needles of an interlock double circular knitting machine of 28 gage, 30 inch diameter and 60 aperture (Model Type V-LEC6 manufactured by Fukuhara Works, Ltd.) to obtain a circular knitted fabric with the distance between unit patterns set to 4 mm. At this time, the loop length of the bare string of polyurethane based elastic fibers was 800 cm, and the loop length of the knitted fabric constituting the front face and the back face was 827 cm, resulting in the loop length ratio (T) of 1.0.

The obtained circular knitted grey fabric was opened, refined by a jet dyeing machine at 80° C. for 30 minutes, and heat-treated at 190° C. for 60 seconds while tentering by 5% in the width direction by a tenter finisher as a preset. Then, the fabric was dyed at 130° C. for 60 minutes using a high pressure jet dyeing machine. The fabric was heat-treated at 170° C. for 45 seconds while tentering by 3% in the width direction using a tenter finisher as a finishing set to obtain a dyed fabric. Knitting specifications and knitting characteristics in this case are shown in Tables 1 and 2.

The obtained three-dimensional knitted fabric had a thickness of 2.65 mm, a compressibility of 60%, a recovery ratio of 92.0% and an air permeability of 0.45, and had a good feel. This three-dimensional knitted fabric was very suitable for inner sole materials of shoes and the like, bed pats of life materials and the like.

EXAMPLE 2

A front knitted fabric and a back knitted fabric of a three-dimensional knitted fabric were knitted in the same manner as in Example 1. A bare string of polyurethane based elastic fibers of 310 decitexes (ROICA® manufactured by Asahi Kasei Corporation) was used as a yarn for binding the front and back knitted fabrics together. At this time, bind-knitting was performed with all needles. The obtained knitted fabric was subjected to processing same as that of Example 1. Knitting specifications and knitting characteristics in this case are shown in Tables 1 and 2.

The obtained three-dimensional knitted fabric had a thickness of 3.12 mm, a compressibility of 55%, a recovery ratio of 99.4% and an air permeability of 0.41, and had a good feel. This three-dimensional knitted fabric was very suitable for inner sole materials of shoes and the like, bed pats of life materials and the like.

EXAMPLE 3

Knitting was performed in the same manner as in Example 2 except that binding was performed with ½ of needles as bind-knitting conditions. Knitting specifications and knitting characteristics in this case are shown in Tables 1 and 2.

The obtained three-dimensional knitted fabric had a thickness of 3.00 mm, a compressibility of 60%, a recovery ratio of 97.4% and an air permeability of 0.55, and had a good feel. This three-dimensional knitted fabric was very suitable for inner sole materials of shoes and the like, bed pats of life materials and the like.

EXAMPLE 4

Knitting was performed in the same manner as in Example 2 except that binding was performed with ¼ of needles as bind-knitting conditions. Knitting specifications and knitting characteristics in this case are shown in Tables 1 and 2. The obtained three-dimensional knitted fabric had a thickness of 2.85 mm, a compressibility of 71%, a recovery ratio of 91.6% and an air permeability of 0.62, and had a good feel. This three-dimensional knitted fabric was very suitable for inner sole materials of shoes and the like, bed pats of life materials and the like.

EXAMPLE 5

A cotton spun yarn No. 40 was used as a yarn for use in a front knitted fabric of a three-dimensional knitted fabric, and a polyester memory twist finished yarn of 167 decitexes and 48 filaments (TECHNOFINE® manufactured by Asahi Kasei Corporation) was used as a yarn for use in a back face to form knitted fabrics of both faces into plain stitch. A bare string of polyurethane based elastic fibers of 310 decitexes (ROICA® manufactured by Asahi Kasei Corporation) was used as a yarn for binding the front and back knitted fabrics together to perform bind-knitting with all needles.

An interlock double circular knitting machine of 22 gage, 30 inch diameter and 36 aperture (Model Type OVJ-36 manufactured by Mayer Cie Co., Ltd.) was used to knit a circular knitted fabric with the distance between unit patterns set to 5 mm. At this time, the loop length of the bare string of polyurethane based elastic fibers was 2160 cm, and the loop length of the knitted fabric constituting the front face and the back face was 1063 cm, resulting in the loop length ratio (T) of 2.0. This circular knitted fabric was subjected to finish processing same as that of Example 1 to obtain a three-dimensional knitted fabric of the present invention. Knitting specifications and knitting characteristics in this case are shown in Tables 1 and 2.

The obtained three-dimensional knitted fabric had a thickness of 3.35 mm, a compressibility of 65%, a recovery ratio of 99.0% and an air permeability of 1.18, and had a good feel. This three-dimensional knitted fabric was very suitable for inner sole materials of shoes and the like, bed pats of life materials and the like.

EXAMPLE 6

A front knitted fabric and a back knitted fabric of a three-dimensional knitted fabric were knitted in the same manner as in Example 5. A bare string of polyurethane based elastic fibers of 34 decitexes (ROICA® manufactured by Asahi Kasei Corporation) was used as a yarn for binding the front and back knitted fabrics together. The obtained circular knitted fabric was subjected to processing same as that of Example 5. Knitting specifications and knitting characteristics in this case are shown in Tables 1 and 2.

The obtained three-dimensional knitted fabric had a thickness of 2.23 mm, a compressibility of 72%, a recovery ratio of 86.2% and an air permeability of 0.45, and had a good feel. This three-dimensional knitted fabric was very suitable for inner sole materials of shoes and the like, bed pats of life materials and the like.

COMPARATIVE EXAMPLE 1

A front knitted fabric and a back knitted fabric of a three-dimensional knitted fabric were knitted in the same manner as in Example 1. A bare string of polyurethane based elastic fibers of 155 decitexes (ROICA® manufactured by Asahi Kasei Corporation) and a polyester core sheathing type heat seal yarn of 83 decitexes and 24 filaments (BELL COUPLE® manufactured by Kanebo Gohsen, Ltd.) were used as yarns for binding the front and back knitted fabrics together. The elastic fibers were arranged with the heat seal yarn multifilament and subjected to confounding processing while the fibers were elongated by a factor of 2.5, and then they were twisted in the twist direction Z at a set number of twists of 600 times/m using the following twisting machine to fabricate a piled yarn.

<Confounding processing> Interlacer (PC-220 Type manufactured by Toray Precision Co., Ltd.) pneumatic pressure; 2.0 $KG/Cm^2G$ <Twisting> Yarn twisting machine; Itarly Yarn Twisting Machine (TKT Type manufactured by Kubota Co., Ltd.)

The obtained twisted yarn was used to bind front and back knitted fabrics together with all needles to knit a circular knitted fabric, the obtained circular knitted fabric was subjected to processing same as that of Example 1. Knitting specifications and knitting characteristics in this case are shown in Tables 1 and 2.

The obtained circular knitted fabric had a thickness of 1.87 mm, a compressibility of 5%, a recovery rate of 82.0% and an air permeability of 1.33. This three-dimensional knitted fabric was poor in compressibility, hard with lack of stereoscopic vision in terms of a feel and the like, and unsuitable for bed pats of life materials and the like.

COMPARATIVE EXAMPLE 2

A front knitted fabric and a back knitted fabric of a three-dimensional knitted fabric were knitted in the same manner as in Example 5. The three-dimensional knitted fabric was knitted just in the same manner as in Example 5 except that a bare string of polyurethane based elastic fibers of 15 decitexes (ROICA® manufactured by Asahi Kasei Corporation) was used as a yarn for binding the front and back knitted fabrics together. Knitting specifications and knitting characteristics in this case are shown in Tables 1 and 2.

The obtained circular knitted fabric had a thickness of 1.95 mm, a compressibility of 80%, a recovery rate of 45% and an air permeability of 0.23, had a soft feel, and was unsuitable for bet pads of life materials and the like in terms of compression recoverability, a feel and the like.

EXAMPLE 7

An interlock double circular knitting machine of 28 gage, 30 inch diameter and 60 aperture (Model Type V-LEC6 manufactured by Fukuhara Works, Ltd.) was used to knit a stretchable circular knitted fabric having a three-layer structure. The distance between unit patterns of the knitting machine was set to 1 mm.

A polyester false twist finished yarn of 56 decitexes and 30 filaments (TECHNOFINE® manufactured by Asahi Kasei Corporation) and a bare string of polyurethane based elastic fibers of 22 decitexes (ROICA® manufactured by Asahi Kasei Corporation) were used as yarns for use in a front knitted fabric and a back knitted fabric of the elastic circular knitted fabric to form a knitted fabric into plain stitch (generally called bare weaves), and a bare string of polyurethane based elastic fibers of 155 decitexes (ROICA) was used as a yarn for binding the front and back knitted fabrics together to tuck-connect the front and back knitted fabrics with ½ of a total number of needles with one needle for front and back knitted fabrics alternately.

At this time, the loop length of the bare string of polyurethane based elastic fibers as a binding yarn, equivalent to one round of the knitting machine, was 190 cm (A), the loop length of the polyester false twist finished yarn constituting one face and the other face was 850 cm (B), and the loop length ratio of the binding yarn (A/B) was 0.22.

The obtained circular knitted grey fabric was opened, refined by a jet dyeing machine at 80° C. for 30 minutes, and heat-treated at 190° C. for 60 seconds while tentering by 5% in the width direction by a tenter finisher as a preset. Then, the fabric was dyed at 130° C. for 60 minutes using a high pressure jet dyeing machine. The fabric was heat-treated at 170° C. for 45 seconds while tentering by 3% in the width direction using a tenter finisher as a finishing set to obtain a dyed fabric. Knitting specifications and knitting characteristics in this case are shown in Tables 3 and 4.

The obtained elastic circular knitted fabric had a three-layer structure with front and back ground knitted fabrics bound together, had a thickness of 0.58 mm, an elongation of 130% in the longitudinal direction and 158% in the lateral direction, elongation recovery rate of 91% in the longitudinal direction and 93% in the lateral direction, and an elastic fiber draw stress of 80 g, and had a good feel.

This elastic circular knitted fabric was free from a run from the end of the knitted fabric, required no sewing on the end surface, and was excellent in fit feeling and shape complementing functions as girdles for ladies.

EXAMPLE 8

Knitting was performed under the same conditions as those in Example 7 except that a bare string of polyurethane based elastic fibers of 44 decitexes (ROICA) was used as a yarn for binding front and back knitted fabrics of an elastic circular knitted fabric to perform bind-knitting with all needles, and same processing as that of Example 7 was carried out to obtain a three-dimensional structure elastic circular knitted fabric.

The obtained elastic circular knitted fabric had a thickness of 0.55 mm, an elongation of 133% in the longitudinal direction and 181% in the lateral direction, elongation recovery rate of 92% in the longitudinal direction and 93% in the lateral direction, and an elastic fiber draw stress of 50 g or greater, and had a good feel.

This elastic circular knitted fabric was free from a run from the end of the knitted fabric, required no sewing on the end surface, and was excellent in fit feeling and shape complementing functions as girdles for ladies.

EXAMPLE 9

An elastic circular knitted fabric was obtained just in the same manner as in Example 8 except that front and back ground knitted fabrics were bound together with ½ of needles as bind-knitting conditions. The obtained three-layer structure elastic circular knitted fabric had a thickness of 0.55 mm, an elongation of 135% in the longitudinal direction and 183% in the lateral direction, elongation recovery rate of 91% in the longitudinal direction and 93% in the lateral direction, and an elastic fiber draw stress of 50 g or greater, and had a good feel.

This elastic circular knitted fabric was free from a run from the end of the knitted fabric, required no sewing on the end surface, and was excellent in fit feeling and shape complementing functions as girdles for ladies.

EXAMPLE 10

An elastic circular knitted fabric was obtained just in the same manner as in Example 8 except that front and back ground knitted fabrics were bound together with ¼ of needles as bind-knitting conditions.

The obtained elastic circular knitted fabric had a thickness of 0.55 mm, an elongation of 137% in the longitudinal direction and 185% in the lateral direction, elongation recovery rate of 91% in the longitudinal direction and 92% in the lateral direction, and an elastic fiber draw stress of 50 g or greater, and had a good feel.

This elastic circular knitted fabric was free from a run from the end of the knitted fabric, required no sewing on the end surface, had good handling characteristics during sewing operations and was excellent in fit feeling and shape complementing functions as girdles for ladies.

EXAMPLE 11

A circular knitting machine of 18 gage, 30 inch diameter and 36 aperture (Model Type OVJ-36 manufactured by Mayer Cie Co., Ltd.) was used to knit a circular knitted fabric.

As yarns for use in a front knitted fabric of the elastic circular knitted fabric, a cotton spun yarn No. 40 and a polyurethane elastic yarn of 22 decitexes (ROICA® manufactured by Asahi Kasei Corporation) were used for the core, and an elastic yarn covered with a nylon finished yarn of 34 decitexes/12 filaments was arranged. A polyester false twist finished yarn of 167 decitexes and 48 filaments (TECHNOFINE) was used as a yarn for use in the back knitted fabric, the knitted fabric of each face was formed into plain stitch, a bare string of polyurethane based elastic fibers of 1422 decitexes (ROICA) was used as a binding yarn for binding the front and back knitted fabrics, and tuck-knitting was performed with ½ of a total number of needles.

At this time, the loop length of the bare string of polyurethane based elastic fibers was 190 cm, the loop lengths of knitted fabrics constituting one face and the other face were both 950 cm, and the loop length ratio was 0.20.

The obtained stretchable knitted fabric had a thickness of 0.78 mm, an elongation of 80% in the longitudinal direction and 100% in the lateral direction, elongation recovery rate of 92% in the longitudinal direction and 93% in the lateral direction, and an elastic fiber draw stress of 80 g or greater, and had a good feel, but suffered curling of the knitted fabric.

This stretchable knitted fabric had a run occurring from the end of the knitted fabric, and therefore the end faces were sewn. The knitted fabric had good handling characteristics during sewing operations, and was excellent in fit feeling and shape complementing functions as girdles for ladies.

EXAMPLE 12

The knitting machine of Example 11 was changed to a rib gatting, first and third yarn feeding ports were set to dial plain stitch and cylinder ½ needle tuck weaves, second and fourth yarn feeding ports were set to cylinder plain stitch and dial ½ needle tuck weaves, and when a cotton spun yarn No. 40 was used as a yarn for use in a front face on the cylinder side, and a polyester false twist finished yarn of 167 decitexes and 48 filaments (TECHNOFINE) was used as a yarn for use in a back face at the dial side to knit a plain stitch part, combined yarn feeding was performed allowing tuck knitting alternately in relative needle rows while knitting a plain stitch part at each yarn feeding port using a bare string of polyurethane based elastic fibers of 34 decitexes (ROICA) as a yarn for binding front and back knitted fabrics together. That is, the connecting yarn was for elastic yarn connection with the knit for one side and the tuck for the corresponding side. For other aspects, operations were carried out in the same manner as in Example 5 to obtain a stretchable knitted fabric.

The obtained stretchable knitted fabric had a thickness of 0.74 mm, an elongation of 80% in the longitudinal direction and 130% in the lateral direction, elongation recovery rate of 93% in the longitudinal direction and 92% in the lateral direction, and an elastic fiber draw stress of 50 g or greater, and had a good feel.

This stretchable knitted fabric had a run occurring from the end of the knitted fabric, and therefore the end faces were sewn. The knitted fabric had good handling characteristics during sewing operations, and was excellent in fit feeling and shape complementing functions as girdles for ladies.

COMPARATIVE EXAMPLE 3

A circular knitting machine of 18 gage, 30 inch diameter and 36 aperture (Model Type OVJ-36 manufactured by Mayer Cie Co., Ltd.) was used to knit a circular knitted fabric.

A cotton spun yarn No. 40 was used as a yarn for use in a front knitted fabric of the stretchable knitted fabric, a polyester false twist finished yarn of 167 decitexes and 48 filaments (TECHNOFINE) was used as a yarn for use in a back knitted fabric, and when a knitted fabric of half-bag weaves was knitted, a bare string of polyurethane based elastic fibers of 1422 decitexes (ROICA) was inflation-inserted at a yarn feeding port of ½ to knit the fabric.

At this time, the loop length of the bare string of polyurethane based elastic fibers was 190 cm, the loop lengths of knitted fabrics constituting one face and the other face were both 760 cm, and the loop length ratio was 0.25.

The obtained stretchable knitted fabric had a thickness of 0.80 mm, an elongation of 45% in the longitudinal direction and 100% in the lateral direction, elongation recovery rate of 60% in the longitudinal direction and 75% in the lateral direction, and a draw stress of 40 g. This stretchable knitted fabric was poor in elongation, and had poor handling characteristics with elastic fibers easily falling off during sewing operations.

COMPARATIVE EXAMPLE 4

A front knitted fabric and a back knitted fabric of a stretchable knitted fabric were knitted in the same manner as in Example 7. Using a bare string of polyurethane based elastic fibers of 155 decitexes (ROICA) and a polyamide multifilament of 44 decitexes and 34 filaments (LEONA) as yarns for binding the front and back knitted fabrics, the elastic fibers were arranged with the polyamide multifilament and subjected to confounding processing under the following condition while the fibers were elongated by a factor of 2.5. Then they were twisted in the twist direction Z at a set number of twists of 600 times/m using the following twisting machine to fabricate a piled yarn.

<Confounding processing> Interlacer (PC-220 Type manufactured by Toray Precision Co., Ltd.) pneumatic pressure; 2.0 $KG/cm^2G$ <Twisting> Yarn twisting machine; Itarly Yarn Twisting Machine (TKT Type manufactured by Kubota Co., Ltd.)

Using the obtained piled yarn as a yarn for binding the front and back knitted fabrics, tuck-knitting was performed with ½ of a number of bindings to knit a circular knitted fabric.

The obtained stretchable knitted fabric had a thickness of 0.60 mm, an elongation of 100% in the longitudinal direction and 120% in the lateral direction, elongation recovery rate of 75% in the longitudinal direction and 60% in the lateral direction, and an elastic fiber draw stress of 100 g, and had an irregular outline.

This stretchable knitted fabric had a bad appearance with a binding yarn protruding from the surface, and was poor in stretchability and thus unsuitable as girdles for ladies.

COMPARATIVE EXAMPLE 5

A stretchable knitted fabric was obtained in the same manner as in Example 5 except that a bare string of polyurethane based elastic fibers of 11 decitexes (ROICA) was used as a yarn for binding front and back knitted fabrics, as in Example 12.

The obtained knitted fabric had a thickness of 0.75 mm, an elongation of 40% in the longitudinal direction and 87% in the lateral direction, and elongation recovery rate of 89% in the longitudinal direction and 75% in the lateral direction, and was poor in stretchability.

EXAMPLE 13

A polyester false twist finished yarn of 84 decitexes and 30 filaments (TECHNOFINE® manufactured by Asahi Kasei Corporation) and a bare string of polyurethane based elastic fibers of 22 decitexes (ROICA® manufactured by Asahi Kasei Corporation) were used as yarns for use in a front knitted fabric and a back knitted fabric of a three-dimensional knitted fabric to arrange these two yarns to form a knitted fabric into plain stitch. A bare string of polyurethane based elastic fibers of 155 decitexes (ROICA® manufactured by Asahi Kasei Corporation) was used as connecting yarn for binding the front and back knitted fabrics together.

An interlock double circular knitting machine of 28 gage, 30 inch diameter and 60 aperture (Model Type V-LEC6 manufactured by Fukuhara Works, Ltd.) was used to perform knitting to obtain a circular knitted fabric with the distance between unit patterns of the knitting machine set to 4.0 mm.

The obtained circular knitted grey fabric was opened, refined by a jet dyeing machine at 80° C. for 30 minutes, and heat-treated at 190° C. for 60 seconds while tentering by 5% in the width direction by a tenter finisher as a preset. Then, the fabric was dyed at 130° C. for 60 minutes using a high pressure jet dyeing machine. The fabric was heat-treated at 170° C. for 45 seconds while tentering by 3% in the width direction using a tenter finisher as a finishing set to obtain a dyed fabric. The obtained knitted fabric was heat-molded for 45 seconds using a mold for heat molding of volume 300 $cm^3$ dry-heated to 190° C. Knitting specifications and knitting characteristics in this case are shown in Tables 5 and 6.

The obtained three-dimensional structure knitted fabric had a mass per unit area of 350 $g/m^2$, a thickness of 2.2 mm, a post-heat molding substrate volume of 210 $cm^3$, and a volume retaining factor of 0.7. This three-dimensional structure knitted fabric was excellent in form fixation characteristics and resilience for recovering an original shape after recessed under an external force, and very suitable for shoe materials, brassiere cup materials, swimming suits and body suits to be molded before use, and shoulder pats, corsets, hats and the like, having the form fixedly retained, as well as outer edge materials and inner edge materials for containers.

EXAMPLE 14

As in the case of Example 13, a polyester false twist finished yarn of 84 decitexes and 30 filaments (TECHNOFINE® manufactured by Asahi Kasei Corporation) and a bare string of polyurethane based elastic fibers of 22 decitexes ( (low-temperature high set type yarn) ROICA BX® manufactured by Asahi Kasei Corporation) were used as yarns for use in a front knitted fabric and a back knitted fabric of a three-dimensional knitted fabric to arrange these two yarns to form a knitted fabric into plain stitch. A bare string of synthetic polyurethane based elastic fibers of 155 decitexes (ROICA® manufactured by Asahi Kasei Corporation) was used as yarn for binding the front and back knitted fabrics together.

The obtained knitted fabric was subjected to processing same as that of Example 13.

The obtained three-dimensional structure knitted fabric had a mass per unit area of 400 $g/m^2$, a thickness of 2.5 mm, a post-heat molding substrate volume of 270 $cm^3$, and a volume retaining factor of 0.9. This three-dimensional structure knitted fabric was excellent in form fixation characteristics and resilience for recovering an original shape after recessed under an external force, and very suitable for shoe materials, brassiere cup materials, swimming suits and body suits to be molded before use, and shoulder pats, corsets, hats and the like, having the form fixedly retained, as well as outer edge materials and inner edge materials for containers.

EXAMPLE 15

A polyester false twist finished yarn of 84 decitexes and 30 filaments (TECHNOFINE® manufactured by Asahi Kasei Corporation) and a bare string of polyurethane based elastic fibers of 22 decitexes (ROICA® manufactured by Asahi Kasei Corporation) were used as yarns for use in a front knitted fabric and a back knitted fabric of a three-dimensional knitted fabric to arrange these two yarns to form a knitted fabric into plain stitch. A bare string of polyurethane based elastic fibers of 78 decitexes (ROICA® manufactured by Asahi Kasei Corporation) was used as a yarn for binding the front and back knitted fabrics together. For other aspects, the knitted fabric was knitted and processed in the same manner as in Example 13.

The obtained three-dimensional structure knitted fabric had a mass per unit area of 230 $g/m^2$, a thickness of 2.1 mm, a post-heat molding substrate volume of 240 $cm^3$, and a volume retaining factor of 0.8. This three-dimensional structure knitted fabric was excellent in form fixation characteristics and resilience for recovering an original shape after recessed under an external force, and very suitable for shoe materials, brassiere cup materials, swimming suits and body suits to be molded before use, and shoulder pats, corsets, hats and the like, having the form fixedly retained, as well as outer edge materials and inner edge materials for containers.

COMPARATIVE EXAMPLE 6

A polyester false twist finished yarn of 84 decitexes and 30 filaments (TECHNOFINE® manufactured by Asahi Kasei Corporation) was used as a yarn for use in front back knitted fabrics of a three-dimensional knitted fabric to form a knitted fabric into plain stitch. The polyester false twist finished yarn of 84 decitexes and 30 filaments (TECHNOFINE® manufactured by Asahi Kasei Corporation) was used as a yarn for binding the front and back knitted fabrics together. For other aspects, the knitted fabric was knitted and processed in the same manner as in Example 13.

The obtained knitted fabric had a mass per unit area of 250 $g/m^2$, a thickness of 1.8 mm, a post-heat molding substrate volume of 120 $cm^3$, and a volume retaining factor of 0.4, and was poor in form retaining characteristics (deformed), and unsuitable for life materials and the like.

EXAMPLE 16

A polyurethane elastic yarn of 155 decitexes (ROICA® manufactured by Asahi Kasei Corporation) was used alone in a bare state as a connecting yarn for binding front and back ground knitted fabrics of a three-dimensional knitted fabric. For the back ground knitted fabric, a polyester false twist finished yarn of 84 decitexes/30 filaments (TECHNOFINE® manufactured by Asahi Kasei Corporation) and a bare string of polyurethane elastic yarn of 22 decitexes (ROICA® manufactured by Asahi Kasei Corporation) were arranged to form a knitted fabric into plain stitch. For the front ground knitted fabric, a false twist finished yarn of nylon of 78 decitexes/34 filaments and the polyurethane elastic yarn of 22 decitexes were arranged to form a knitted fabric in the same manner as in the formation of the back knitted fabric.

As a knitting machine, double circular knitting machine of 28 gage, 30 inch diameter and 60 aperture (Model Type V-LEC6 manufactured by Fukuhara Works, Ltd.) was used. The tooth space between a dial needle and a cylinder needle of the knitting machine was set to 4 mm. The non-elastic nylon false twist finished yarn for forming the front ground knitted fabric was fed from a yarn feeding port 1 to the cylinder needle in a feeding length (loop length) of 827 cm per one rotation of the knitting machine, and the non-elastic polyester false twist finished yarn for forming the back ground knitted fabric was fed from a yarn feeding port 2 to a dial needle in the same feeding length (loop length) of 827 cm per one rotation of the knitting machine.

An apparatus for actively delivering in a bare state from a package the polyurethane elastic yarn to be arranged with a main material forming the ground knitted fabric was used. The yarn was fed from the first yarn feeding port and the second yarn feeding port of the knitting machine to knitting needles in a feeding length of 410 cm per one rotation of the knitting machine (draw ratio of polyurethane elastic yarn during knitting was 2.0), and plain knitted to form the front and back ground fabrics. The connecting yarn was fed in double tuck weaves from a third yarn feeding port to short butt needles for both dial and cylinder needles in a feeding length of 800 cm per one rotation of the knitting machine, and the ground knitted fabrics formed at the first yarn feeding port and the second yarn feeding port were bound in tuck stitches. Operations at the first yarn feeding port and the second yarn feeding port were repeated at a fourth yarn feeding port and a fifth yarn feeding port, respectively, and at a sixth yarn feeding port, the polyurethane elastic yarn was fed to long butt needles for dial and cylinder needles as in the case of the third yarn feeding port.

With this yarn as one complete weave, a fabric was knitted at 60 aperture yarn feeding port. Since connecting yarn was knitted in double tuck weaves with the short butt needle and the long butt needle alternately for each course, the stitch rate of the ground knitted fabric bound to the connecting yarn was 50%, and the connection site was shifted in phase for each course.

The obtained circular knitted grey fabric was opened, refined by a jet dyeing machine at 80° C. for 30 minutes, heat-treated at 190° C. for 60 seconds while tentering by 5% in the width direction by a tenter finisher as a preset, and then dyed on the nylon side with an acid dye at 100° C. for 60 minutes using a high pressure jet dyeing machine. The fabric was heat-treated at 170° C. for 45 seconds while tentering by 3% in the width direction using a tenter finisher as a finishing set to obtain a dyed fabric.

The obtained three-dimensional knitted fabric had a thickness of 1.8 mm, a knitting density of 25.5 courses/cm×14.6 wale/cm, a total connection number per square cm of 373, connecting yarn total decitexes per square cm of 57, 780 decitexes, and D/T of 32, 100. This elastic knitted fabric had a compressibility of 54% and a recovery rate of 100%, and thus had sufficient compressibility. The knitted fabric had an air flow resistance of 0.24 kPa·-s/m, and was sufficiently stretchable in both warp and weft directions of the knitted fabric, and completely reversible for back and front faces.

EXAMPLE 17

A polyurethane elastic yarn of 78 decitexes (ROICA® manufactured by Asahi Kasei Corporation) was used alone in a bare state as polyurethane elastic fibers for a connecting yarn for binding ground knitted fabrics together, and a polyester gray yarn of 84 decitexes/30 filaments (TECHNOFINE® manufactured by Asahi Kasei Corporation) and a polyurethane elastic yarn of 22 decitexes (ROICA® manufactured by Asahi Kasei Corporation) were used in a bare state for front and back ground knitted fabrics. As a knitting machine, a double raschel warp knitting machine of 18 gage provided with five guide bars (manufactured by Karl Mayer Co., Ltd.) with the distance between unit patterns set to 4 mm was used. The polyester gray yarn and the polyurethane elastic yarn for the ground knitted fabrics were fed to only a front needle from a first guide bar and a second guide bar to knit a double 1×1tricot stitch weave. Two types of yarns were similarly fed to only a back needle from a fourth guide bar and a fifth guide bar to knit a half weave. From a third guide bar, a bare string of polyurethane elastic yarn was fed as a connecting yarn to both the front needle and back needle alternately in a full set, and a knit loop was knitted and connected to the ground knitted fabrics. The obtained warp knitted grey fabric was refined by a continuous refining machine at 80° C. for 30 minutes, heat-treated at 190° C. for 60 seconds while tentering by 5% in the width direction by a tenter finisher as a preset, and then dyed at 130° C. for 60 minutes using a high pressure jet dyeing machine. The fabric was heat-treated at 170° C. for 45 seconds while tentering by 3% in the width direction using a tenter finisher as a finishing set to obtain a dyed fabric.

The obtained elastic knitted fabric had a thickness of 2.5 mm, a knitting density of 23.6 courses/cm×11.8 wale/cm, total connection number per square cm of 558, connecting yarn total decitexes per square cm of 43,524 decitexes, and D/T of 17,410.

This elastic knitted fabric had a compressibility of 69% and a recovery rate of 99.4%, and thus had sufficient compressibility. The knitted fabric had a satisfactory air flow resistance of 0.33, and was sufficiently stretchable in both warp and weft directions of the knitted fabric. The obtained elastic knitted fabric was molded under dry heat conditions at 180° C. for 30 seconds using a rugged human face mold made of aluminum, resulting in a knitted fabric most suitable as an eye mask having a shape of a human face.

EXAMPLE 18

A knitting machine same as that of Example 16 was used, no elastic yarn was used for a back ground knitted fabric, and an elastic yarn having a polyurethane elastic yarn of 22 decitexes (ROICA® manufactured by Asahi Kasei Corporation) as a core covered with a nylon finished yarn of 34 decitexes/12 filaments was used for a front ground knitted fabric. In the same manner as in Example 16 for other aspects, this elastic yarn was arranged with non-elastic fibers at a rate of one of two of fibers to form a knitted fabric into plain stitch.

The obtained elastic knitted fabric had a thickness of 2.0 mm, a knitting density of 18 courses/cm×11 wale/cm, total connecting yarn number per cm of 198, and D/T of 17,050. This elastic knitted fabric had a compressibility of 69% and a recovery rate of 99.9%, and thus had sufficient compressibility. The elastic knitted fabric was sufficiently stretchable in both warp and weft directions of the knitted fabric, and most suitable as upper materials for shoes and boots.

EXAMPLE 19

A double circular knitting machine of 22G comprising a jacquard patterning mechanism with needle selection was used, a false twist finished yarn of nylon of 78 decitexes/34 filaments and a gray yarn of polyester 84 of decitexes/30 filaments were fed to the cylinder side to knit a flowered two-color jacquard and at the same time, a polyurethane elastic yarn of 44 decitexes (ROICA® manufactured by Asahi Kasei Corporation) was plated in a bare state to form a front ground knitted fabric.

A gray yarn of polyester of 84 decitexes/30 filaments was fed to the dial needle to knit a plain-knitted fabric and at the same time, a polyurethane elastic yarn of 44 decitexes (ROICA® manufactured by Asahi Kasei Corporation) was plated in a bare state to form a back ground knitted fabric. The front and back two ground knitted fabrics were bound together by performing double tuck knitting alternately with a short butt needle and a long butt needle using a polyurethane elastic yarn of 310 decitexes (ROICA® manufactured by Asahi Kasei Corporation) as a connecting yarn in the same manner as in Example 16.

The obtained circular knitted grey fabric was opened, refined by a jet dyeing machine at 80° C. for 30 minutes, heat-treated at 190° C. for 60 seconds while tentering by 5% in the width direction by a tenter finisher as a preset, and then dyed on the nylon side with an acid dye at 100° C. for 60 minutes using a high pressure jet dyeing machine. The fabric was heat-treated at 170° C. for 45 seconds while tentering by 3% in the width direction using a tenter finisher as a finishing set to obtain a dyed fabric.

The obtained knitted fabric had a thickness of 5 mm, a density of 28 courses/cm×15 wale/cm, a connecting yarn total number of 420, and D/T of 26,040. This elastic knitted fabric had a compressibility of 50% and a recovery rate of 100%, and thus had sufficient compressibility. The knitted fabric was sufficiently stretchable in both warp and weft directions, and had white stitches knitted with polyester on the surface, thus being most suitable for warm swimming suits having flowered patterns.

EXAMPLE 20

In knitting an elastic knitted fabric of the present invention with similar yarn handling operations by a double raschel warp knitting machine used in Example 17, 80 course knitting was performed in the same manner as in Example 17 and in next 10 courses, a polyester gray yarn in a second guide bar was knitted with both front and back needles to form a knit loop, during which a connecting yarn was prevented from being connected to ground knitted fabrics, and inserted between two ground knitted fabrics in a float yarn state.

Then, a return was made to the original knitted weave to perform knitting of 80 courses, and this operation was repeated. The obtained elastic knitted fabric had border-type irregularities with a three-dimensional site partitioned every 3 cm in the warp direction of the knitted fabric. This elastic knitted fabric had a recessed portion, and therefore could be easily bent on the whole, thus being most suitable for supporters and the like to be wound around the human body.

COMPARATIVE EXAMPLE 7

Using a knitting machine same as that of Example 16, a knitted fabric was knitted with weaves and conditions same as those of Example 16. At this time, yarn handling for the ground knitted fabric was carried out in the same manner as in Example 16, and a false twist finished yarn of polyester of 167 decitexes/48 filaments was used as a binding yarn. The obtained knitted fabric was dye-finished using steps and conditions same as those of Example 16.

This knitted fabric had a thickness of 2.2 mm, a knitting density of 25.5 courses/cm×14.6 wale/cm, total connection number per square cm of 373, connecting yarn total decitexes per square cm of 62,291 decitexes, and D/T of 22,246.

This knitted fabric had a compressibility of 62%, a recovery rate of 68.8%, and an air flow resistance of 0.64 kPa·-s/m. The knitted fabric was sufficiently stretchable in both warp and weft directions of the knitted fabric, but was poor in elasticity when compressed in the thickness direction, and insufficient in compression recoverability such that it took much time for recovery from compression and permanent deformation remains on the surface of the knitted fabric for a long time. Furthermore, the knitted fabric was filled with fibers at the connection part and inferior in air permeability to the elastic fabric of the present invention. Further, this knitted fabric was dyed in a rope state, and thus had rope creases persistent on the surface of the knitted fabric after finish setting. When the knitted fabric was wound around the human body, bent creases occurred inside the knitted fabric along the curved line of the human body, and the creases never disappeared even after the knitted fabric was recovered to the original state.

COMPARATIVE EXAMPLE 8

Using a knitting machine same as that of Example 16, a knitted fabric was knitted with weaves and conditions same as those of Example 1. At this time, no polyurethane elastic yarn was used for front and reserve ground knitted fabrics, and a cover elastic yarn having a polyurethane elastic yarn of 155 decitexes as a core, around which a polyester core-sheathing type heat seal yarn of 167 decitexes/16 filaments was wound, was used as a connecting yarn. At this time, the ratio of the covering draft of the elastic yarn was 2.5, and the number of twists of the cover yarn was 300 times/m. Since the connecting yarn was a cover elastic yarn, a delivering apparatus to be used when knitting a well known polyurethane elastic yarn in a bare state, was not used.

For other aspect, the knitted fabric was knitted and dye finishing was performed in the same manner as in Example 16. The obtained knitted fabric had a thickness of 1.4 mm, a knitting density of 14 courses/cm×11.5 wale/cm, total connection number per square cm of 161, connecting yarn total decitexes per square cm of 24,955 decitexes, and D/T of 17,825. This elastic knitted fabric had a compressibility of 58%, a recovery rate of 72.0%, and an air flow resistance of 0.14 kPa.-s/m.

This knitted fabric had a small air flow resistance, but was so poor in compression recoverability in the thickness direction that plastic deformation occurred by compression. It was not a knitted fabric desired in the present invention. Furthermore, the connecting yarn was heat-sealed during dyeing, thus bringing about a satisfactory level of binding between the connecting yarn and the ground knitted fabric, but the heat-sealed part was hard, and the knitted fabric as a whole had a hard feel, and was hard to be bent, and the knitted fabric was thus unsuitable as a knitted fabric to be worn by a person or used at a location close to the skin as desired in the present invention. Furthermore, as in the case of Comparative Example 16, the knitted fabric had a disadvantage such that the inside ground knitted fabric was creased as the knitted fabric was bent.

INDUSTRIAL APPLICABILITY

An elastic circular knitted fabric having a three-layer structure, and an elastic warp knitted fabric of the present invention are free from curling such that the year part of the knitted fabric is curled, excellent in form stability, and excellent in elongation recoverability, thinness feeling and surface quality. Furthermore, the present invention can provide an elastic knitted fabric having a good warp and weft elongation balance compared with a stretch gray yarn capable of being manufactured by a single circular knitting machine or single warp knitting machine of the prior art, and being most suitable for underwear, foundations, sport wear, supporters and the like. Furthermore, the size of polyurethane based elastic fibers can be selected and applied for each fabric having unprecedented stretchability in shape supplement applications.

An elastic circular knitted fabric having a three-dimensional structure, and an elastic warp knitted fabric of the present invention are suitably used for shoe materials such as pad materials in shoes, upper materials for shoes and boots and slippers, bag materials such as bag fabrics and protection cases for glasses and cellular phones, pats such as bed pats, brassiere pats and shoulder pats, cover materials such as pillow covers, masks such as masks, eye masks and face masks, medical sub materials such as supporters, wound protection materials, protectors and diaper covers, leg materials such as tights, socks and leg warmers, sport cloths such as protective shorts, sliding shorts and jump shorts, underwear such as thermal insulation inners and tensile outer garments such as jumpers.

TABLE 1

| | Yarn used | | | | | Loop length | | | Knitted weave | |
|---|---|---|---|---|---|---|---|---|---|---|
| | Front face | | Back face | | | Ground | | | Binding yarn | |
| | Non-elastic yarn | Elastic yarn | Non-elastic yarn | Elastic yarn | Binding yarn | knitted fabric (shorter) | Binding yarn | Loop length ratio | Number of bindings | Elastic yarn |
| Example 1 | PET84 | None | PET84 | None | PU155 | 827 | 800 | 1.0 | ALL | tuck |
| Example 2 | PET84 | None | PET84 | None | PU310 | 827 | 800 | 1.0 | ALL | tuck |
| Example 3 | PET84 | None | PET84 | None | PU310 | 827 | 800 | 1.0 | ½ | tuck |
| Example 4 | PET84 | None | PET84 | None | PU310 | 827 | 800 | 1.0 | ¼ | tuck |
| Example 5 | Cotton40 | None | PET167 | None | PU310 | 1063 | 2160 | 2.0 | ALL | tuck |
| Example 6 | Cotton40 | None | PET167 | None | PU34 | 1063 | 2160 | 2.0 | ALL | tuck |
| Comparative Example 1 | PET84 | None | PET84 | None | (Heat-seal yarn/PU) piled yarn | 827 | 800 | 1.0 | ALL | tuck |
| Comparative Example 2 | Cotton40 | None | PET167 | None | PU15 | 1063 | 2160 | 2.0 | ALL | tuck |

TABLE 2

| | Knitted fabric properties | | | |
|---|---|---|---|---|
| | Knitted fabric quantity Thickness mm | Compressibility % | Compression recovery % | Air flow resistance KPa |
| Example 1 | 2.65 | 60 | 92.0 | 0.45 |
| Example 2 | 3.12 | 55 | 99.4 | 0.41 |
| Example 3 | 3.00 | 60 | 97.4 | 0.55 |
| Example 4 | 2.85 | 71 | 91.6 | 0.62 |
| Example 5 | 3.35 | 65 | 99.0 | 1.18 |
| Example 6 | 3.23 | 72 | 86.2 | 0.45 |
| Comparative Example 1 | 1.87 | 5 | 82.0 | 1.33 |
| Comparative Example 2 | 1.95 | 80 | 45.0 | 0.23 |

TABLE 3

| | Yarn used | | | | | Loop length | | | Knitted weave | |
|---|---|---|---|---|---|---|---|---|---|---|
| | Front face | | Back face | | | Ground | | | Binding yarn | |
| | Non-elastic yarn | Elastic yarn | Non-elastic yarn | Elastic yarn | Binding yarn | knitted fabric (shorter) | Binding yarn | Loop length ratio | Number of bindings | Elastic yarn |
| Example 7 | PRT56 | PU22 | PRT56 | PU22 | PU155 | 850 | 190 | 0.22 | ½ | tuck |
| Example 8 | PRT56 | PU22 | PRT56 | PU22 | PU44 | 850 | 190 | 0.22 | ALL | tuck |
| Example 9 | PRT56 | PU22 | PRT56 | PU22 | PU44 | 850 | 190 | 0.22 | ½ | tuck |
| Example 10 | PRT56 | PU22 | PRT56 | PU22 | PU44 | 850 | 190 | 0.22 | ¼ | tuck |
| Example 11 | Cotton40 | PU/Ny Cover Yarn | PET167 | | PU1422 | 950 | 190 | 0.20 | ½ | tuck |
| Example 12 | Cotton40 | | PET167 | | PU34 | 950 | 350 | 0.37 | ½ | tuck/ knit |
| Comparative Example 3 | PET167 | | Cotton40 | | PU1422 | 760 | 190 | 0.25 | ½ | in-lay |
| Comparative Example 4 | PRT56 | PU22 | PRT56 | PU22 | (Ny/ PU) Piled yarn | 850 | 190 | 0.22 | ½ | tuck |
| Comparative Example 5 | PET167 | | Cotton40 | | PU11 | 1130 | 170 | 0.15 | ½ | tuck |

TABLE 4

| | Knitted fabric quantity | Elongation (%) | | | | | | | | | |
|---|---|---|---|---|---|---|---|---|---|---|---|
| | | Elongation under load of 3.5 N/cm | | | Elongation under load of 9.8 N/cm | | | Elongation recovery rate (%) | | Connecting yarn draw stress | Appearance of grey fabric |
| | Thickness mm | Elongation Warp | Elongation Weft | Elongation (A) | Elongation Warp | Elongation Weft | Elongation (B) | Warp | Weft | (CN) | |
| Example 7 | 0.58 | 80 | 75 | 107 | 130 | 158 | 82 | 91 | 93 | 80 | Good |
| Example 8 | 0.55 | 120 | 120 | 100 | 133 | 181 | 73 | 92 | 93 | cut | Good |
| Example 9 | 0.55 | 120 | 130 | 92 | 135 | 183 | 74 | 91 | 93 | cut | Good |
| Example 10 | 0.55 | 120 | 110 | 109 | 137 | 185 | 74 | 91 | 92 | cut | Good |
| Example 11 | 0.78 | 80 | 70 | 114 | 80 | 100 | 80 | 92 | 93 | cut | Good |
| Example 12 | 0.74 | 120 | 130 | 92 | 80 | 130 | 62 | 93 | 92 | cut | Good |
| Comparative Example 3 | 0.8 | 40 | 70 | 57 | 45 | 100 | 45 | 60 | 75 | 40 | Good |
| Comparative Example 4 | 0.6 | 80 | 120 | 67 | 100 | 120 | 83 | 75 | 60 | 100 | Poor irregularities |
| Comparative Example 5 | 0.75 | 35 | 60 | 58 | 40 | 87 | 46 | 89 | 75 | cut | Poor irregularities |

TABLE 5

| | Yarn used | | | | | Loop length | | | Knitted weave | |
|---|---|---|---|---|---|---|---|---|---|---|
| | Front face | | Back face | | | Ground | | | Binding yarn | |
| | Non-elastic yarn | Elastic yarn | Non-elastic yarn | Elastic yarn | Binding yarn | knitted fabric (shorter) | Binding yarn | Loop length ratio | Number of bindings | Elastic yarn |
| Example 13 | PET84 | PU22 | PET84 | PU22 | PU155 | 850 | 800 | 0.94 | ½ | tuck |
| Example 14 | PET84 | PU22 | PET84 | PU22 | PU155 | 850 | 800 | 0.94 | ½ | tuck |
| Example 15 | PET84 | PU22 | PET84 | PU22 | PU78 | 850 | 800 | 0.94 | ½ | tuck |
| Comparative Example 6 | PET84 | | PET84 | | PET84 | 850 | 800 | 0.94 | ½ | tuck |
| Example 16 | Ny78 | PU22 | PET84 | PU22 | PU155 | 827 | 800 | 0.97 | ½ | tuck |
| Example 17 | PET84 | PU22 | PET84 | PU22 | PU78 | | | | ALL | knit |
| Example 18 | NY78 | PU/Ny Piled yarn | PET84 | | PU155 | | | | ½ | tuck |
| Example 19 | Ny78/ PET84 | PU44 | PET84 | PU44 | PU310 | | | | ½ | tuck |
| Example 20 | PET84 | PU22 | PET84 | PU22 | PU78 | | | | ¼ | knit |
| Comparative Example 7 | Ny78 | PU22 | PET84 | PU22 | PET167 | 827 | 800 | 0.97 | ½ | tuck |
| Comparative Example 8 | Ny78 | | PET84 | | PU/PET Piled yarn | 827 | 800 | 0.97 | ½ | tuck |

TABLE 6

| | Knitted fabric quantity | Knitted fabric properties | | | Volume |
|---|---|---|---|---|---|
| | Thickness mm | Compressibility % | Compression recovery % | Air flow resistance KPa | retaining factor |
| Example 13 | 2.2 | | | | 0.7 |
| Example 14 | 2.5 | | | | 0.9 |
| Example 15 | 2.1 | | | | 0.8 |
| Comparative Example 6 | 1.8 | | | | 0.4 |
| Example 16 | 1.8 | 17 | 100 | 0.24 | |
| Example 17 | 2.5 | 69 | 99.4 | 0.33 | |
| Example 18 | 2 | 36 | 99.9 | — | |
| Example 19 | 5 | 20 | 100 | — | |
| Example 20 | — | — | — | — | |

TABLE 6-continued

| | Knitted fabric quantity | Knitted fabric properties | | | Volume |
|---|---|---|---|---|---|
| | Thickness mm | Compressibility % | Compression recovery % | Air flow resistance KPa | retaining factor |
| Comparative Example 7 | 2.4 | 62 | 79 | 0.64 | |
| Comparative Example 8 | 1.4 | 37 | 88 | 0.14 | |

The invention claimed is:

1. An elastic knitted fabric comprising a multilayer structure which is made by binding together separate front and back ground knitted fabrics each of which is formed by one needle bed of a knitting machine having two needle beds, wherein at least one of the ground knitted fabrics form stitches in a state in which polyurethane based elastic fibers as a bare string and a non-elastic yarn are arranged and said ground knitted fabrics are bound with only a binding yarn(s) constituted by a polyurethane based elastic fiber bare string (s) of 17 to 3000 decitexes.

2. The elastic knitted fabric according to claim 1, wherein said elastic knitted fabric is a circular knitted fabric with the separate front and back ground knitted fabrics each formed by one needle bed, the ground knitted fabrics being bound together by a tuck loop of only a binding yarn(s) constituted by a polyurethane based elastic fiber bare string(s) of 33 to 3000 decitexes, wherein either of said separate front and back ground knitted fabrics has a smaller loop length than the other, the binding yarn(s) is bound to 25% or more of stitches of one of the separate front and back ground knitted fabrics having a lower stitch density, a ratio of the loop length of the binding yarn(s) to the loop length of the one of said separate front and back ground knitted fabrics having a smaller loop length is in a range of 0.6 to 2.3, and the elastic knitted fabric has an air gap between the front and back ground knitted fabrics and has a three dimensional structure.

3. The elastic knitted fabric according to claim 1, wherein said elastic knitted fabric is a circular knitted fabric with the separate front and back ground knitted fabrics each formed by one needle bed, the ground knitted fabrics being bound together with only a binding yarn(s) constituted by a polyurethane based elastic fiber bare string(s) of 17 to 1500 decitexes, wherein either of said separate front and back ground knitted fabrics has a smaller loop length than the other, at least one of the ground knitted fabrics is bound by a tuck loop to the binding yarn(s), the binding yarn(s) is bound to 25% or more of stitches of one of the separate front and back ground knitted fabrics having a lower stitch density, a ratio of the loop length of the binding yarn(s) to the loop length of the one of said separate front and back ground knitted fabrics having a smaller loop length Is in a range of 0.2 to 0.6, and the elastic knitted fabric has a three-layer structure.

4. The elastic knitted fabric according to claim 1, wherein each of said ground knitted fabrics has a warp-knitted structure, either of said separate front and back ground knitted fabrics has a nailer loop length than the other, and said binding yarn(s) is bound to 25% or more of stitches of one of the separate front and back ground knitted fabrics having a lower stitch density.

5. The elastic knitted fabric according to any one of claims 1 to 4, wherein at least one of the ground knitted fabrics contains an elastic composite yarn.

6. The elastic knitted fabric according to any one of claims 1 to 4, wherein both the front and back ground knitted fabrics form stitches in a state in which polyurethane based elastic fibers as a bare string and a non-elastic yarn are arranged.

7. The elastic knitted fabric according to one of claims 1 to 4, wherein the size of the polyurethane based elastic fibers in the at least one ground knitted fabric is (D-g), and the size of the polyurethane based elastic fibers in the bare string(s) of the binding yarn(s) is (D-c), and the ratio (D-c/D-g)≧2 is satisfied.

8. The elastic knitted fabric according to any one of claims 1, 2, or 4, wherein the ratio of the gross size of a binding yarn(s) for binding 1 $cm^2$ of ground knitted fabric: D (decitex) to the thickness of the elastic knitted fabric: T (mm) is:

$$5\times10^3 \leqq D/T \leqq 5\times10^5.$$

9. The elastic knitted fabric according to claim 6, wherein the elongations in warp and weft directions are each 80 to 150% under a load of 3.5 N/cm and 100 to 200% under a load of 9.8 N/cm, an elongation ratio(A) and an elongation ratio (B) in warp and weft directions, expressed by the following equations (1) and (2) are each in a range of 0.6 to 1.2:

elongation ratio (*A*)=elongation (%) in warp direction under load of 3.5 N/cm÷elongation in weft direction (%); (1)

elongation ratio (*B*)=elongation (%) in warp direction under load of 9.8 N/cm÷elongation in weft direction (%).

10. The elastic knitted fabric according to any one of claims 1 to 4 wherein the elastic knitted fabric has a recessed portion or raised portion formed and fixed by heat molding, and has a three-dimensional structure.

11. The elastic knitted fabric according to claim 10, wherein the volume retaining factor of a mold molded by heat molding, defined below, is 0.5 or greater:

volume retaining factor=(molding volume retained by molded elastic knitted fabric)/heat molding volume).

12. The elastic knitted fabric according to any one of claims 1 to 4, wherein two or more types of non-elastic yarns are used in at least one of the ground knitted fabrics, and a jacquard pattern is provided by the two or more types of non-elastic yarns.

13. The elastic knitted fabric according to claim 2 or 4, wherein a part of the elastic knitted fabric having a three-dimensional structure and an air gap between the front and back two ground knitted fabrics is bound in a contact state with a non-elastic yarn forming a part of the binding yarn(s) and/or a ground knitted fabric.

14. A molded cloth, at least part of which is formed by a non-sewn cylindrical circular knitted fabric, wherein the cylindrical circular knitted fabric is the elastic knitted fabric according to any one of claims 1 to 4.

15. A process for manufacturing the elastic knitted fabric according to any one of claims 1 to 4 comprising knitting a knitted fabric containing an elastic yarn by a circular knitting machine, wherein a feed speed (V-g) of a bare string of polyurethane based elastic fibers for knitting a ground knitted fabric is unequal to a feed speed (V-c) of a bare string of polyurethane based elastic fibers of the binding yarn(s) for binding the front and back ground knitted fabrics.

16. The process according to claim 15, wherein the bare string of polyurethane based elastic fibers of the binding yarn(s) for binding the front and back two-layer ground knitted fabrics is fed at a controlled draw ratio of 2 or less.

* * * * *

UNITED STATES PATENT AND TRADEMARK OFFICE

CERTIFICATE OF CORRECTION

PATENT NO. : 7,240,522 B2
APPLICATION NO. : 10/492358
DATED : July 10, 2007
INVENTOR(S) : Toshiyuki Kondou et al.

It is certified that error appears in the above-identified patent and that said Letters Patent is hereby corrected as shown below:

On the Title page, in item (*) Notice:, Please delete "This patent is subject to a terminal disclaimer".

In claim 3, column 37, line 36, "Is" should read --is--.

In claim 4, column 37, line 42, "nailer" should read --smaller--.

Signed and Sealed this

Twenty-fourth Day of June, 2008

JON W. DUDAS
*Director of the United States Patent and Trademark Office*